US010676160B2

(12) United States Patent
Atallah et al.

(10) Patent No.: US 10,676,160 B2
(45) Date of Patent: Jun. 9, 2020

(54) MOORING AND TENSIONING METHODS, SYSTEMS, AND APPARATUS

(71) Applicant: BARDEX CORPORATION, Goleta, CA (US)

(72) Inventors: Nick Atallah, Goleta, CA (US); Dennis Graney, Goleta, CA (US)

(73) Assignee: Bardex Corporation, Goleta, CA (US)

( * ) Notice: Subject to any disclaimer, the term of this patent is extended or adjusted under 35 U.S.C. 154(b) by 0 days.

(21) Appl. No.: 16/172,285

(22) Filed: Oct. 26, 2018

(65) Prior Publication Data

US 2020/0055569 A1 Feb. 20, 2020

Related U.S. Application Data

(60) Provisional application No. 62/765,155, filed on Aug. 17, 2018.

(51) Int. Cl.

| | |
|---|---|
| ***B63B 21/00*** | (2006.01) |
| ***B63B 21/10*** | (2006.01) |
| ***B63B 21/18*** | (2006.01) |
| ***B63B 21/56*** | (2006.01) |
| ***B63B 21/50*** | (2006.01) |

(52) U.S. Cl.

CPC ..... *B63B 21/10* (2013.01); *B63B 21/18* (2013.01); *B63B 21/50* (2013.01); *B63B 21/56* (2013.01); *B63B 2021/566* (2013.01)

(58) Field of Classification Search

CPC ..... B63B 21/04; B63B 21/10; B63B 21/18; B63B 21/20; B63B 21/50; B63B 21/56; B63B 2021/003; B63B 2021/004; B63B 2021/20; B63B 2021/203; B63B 2021/566

USPC ..... 114/230.2, 230.22, 230.25, 230.26, 210, 114/213, 215, 216, 249, 253

See application file for complete search history.

(56) References Cited

U.S. PATENT DOCUMENTS

| | | | | |
|---|---|---|---|---|
| 5,845,893 | A | 12/1998 | Groves | |
| 6,983,714 | B2 | 1/2006 | Dove et al. | |
| 7,059,262 | B2 | 6/2006 | Dove et al. | |
| 8,915,205 | B2 | 12/2014 | Miller et al. | |
| 9,003,994 | B2 * | 4/2015 | Leverette | B63B 21/18 114/230.24 |
| 9,126,659 | B2 | 9/2015 | Miller et al. | |
| 9,340,261 | B2 | 5/2016 | Macrae | |
| 2004/0231579 | A1 | 11/2004 | Macrae et al. | |
| 2010/0024706 | A1 * | 2/2010 | Foo | B63B 21/50 114/264 |

(Continued)

OTHER PUBLICATIONS

Hywind Scotland Pilot Park Environmental Statement; Apr. 2015; 462 Pages; Statoil; Relevant Pages Section 4.4.2.

(Continued)

*Primary Examiner* — Daniel V Venne

(74) *Attorney, Agent, or Firm* — Michael S. McCoy; Amatong McCoy LLC

(57) ABSTRACT

A method of mooring a floating vessel having a fairlead stopper coupled thereto is provided. The method includes retrieving a line pre-reeved on the fairlead stopper, connecting the line to an upper end of a mooring line, retrieving a second end of the line, connecting the second end to a winch of the AHV, and hauling in the mooring line to apply tension thereto. Also disclosed are mooring lines and systems, including lines having tensioning connectors thereon, such as tri-plate connectors, for stretching lines.

28 Claims, 22 Drawing Sheets

(56) References Cited

U.S. PATENT DOCUMENTS

| | | | |
|---|---|---|---|
| 2014/0026796 | A1 | 1/2014 | Leverette et al. |
| 2016/0185427 | A1 | 6/2016 | Macrae |
| 2018/0086421 | A1 | 3/2018 | O'Rourke et al. |

OTHER PUBLICATIONS

International Search Report and Written Opinion dated Jan. 17, 2019 (issued in PCT Application No. PCT/US2018/057794) [7 pages].

* cited by examiner

MOORING AND TENSIONING METHODS, SYSTEMS, AND APPARATUS

CROSS-REFERENCE TO RELATED APPLICATIONS

The present application claims the benefit of U.S. Provisional Patent Application No. 62/765,155, filed on Aug. 17, 2018, the entirety of which is incorporated herein by reference and made a part of the present disclosure.

FIELD

The present disclosure relates to methods, systems, and apparatus for mooring vessels and tensioning mooring lines.

BACKGROUND

In many applications, floating vessels or structures require mooring, such as in offshore drilling platform applications. The mooring lines typically require at least some tensioning to securely moor the vessel or structure. One approach to mooring and tensioning includes the use of so called "in-line tensioners". When tensioning using an in-line tensioner, the in-line tensioner does not pass chain smoothly. Rather, the in-line tensioner lifts vertically as an Anchor Handling Vessel (AHV) pulls on the chain from above until enough energy is stored to suddenly open latches, similar to the plucking of a bow string. At this point the in-line tensioner body runs down the chain in an uncontrolled manner until it reaches equilibrium again and rests on a new link in the chain. Then, the in-line tensioner is lifted again, repeating the process as the mooring line gets successively tighter and tighter. This "yo-yo like" action creates the possibility of damage to the chain or the tensioner assembly. For safety and other purposes, such uncontrolled movements should typically be avoided whenever possible given the operating loads involved in such applications. For these and other reasons, it would be desirable to have options other than using in-line tensioners for mooring vessels.

BRIEF SUMMARY

One aspect of the present disclosure includes a method of mooring a floating vessel having a fairlead stopper coupled thereto. The method includes coupling a first end of a messenger line to a first end of a mooring line. The messenger line is reeved through the fairlead stopper of the floating vessel. The second end of the mooring line is anchored to a seafloor. The method includes coupling a second end of the messenger line on an anchor handling vessel. The method includes coupling a first end of a tensioning line, extending from the anchor handling vessel, with a tension coupler. The tension coupler is coupled with the mooring line. The method includes hauling in the mooring line into and at least partially through the fairlead stopper by pulling the second end of the messenger line onto the anchor handling vessel. The mooring line is hauled in until a first tension on the mooring line is attained. The fairlead stopper secures a position of the mooring line to at least partially maintain the first tension on the mooring line. The method include, while hauling in the mooring line, pulling the tensioning line toward the anchor handling vessel to apply tension thereto.

Another aspect of the present disclosure includes a mooring line. The mooring line includes a bottom chain coupled with an anchor at a seafloor, a midspan line coupled with the bottom chain, a top chain coupled with the midspan line opposite the bottom chain, a d a tension coupler coupled with the mooring line. The tension coupler is configured (i.e., sized, shaped, positioned and arranged) for attachment with a tensioning line of an anchor handling vessel.

Another aspect of the present disclosure includes a mooring system. The system includes an anchor handling vessel, including a first winch and a second winch. The second winch includes a tensioning line coupled therewith. The system includes a mooring line coupled with an anchor at a seafloor, and a tension coupler coupled with the mooring line. The tension coupler is configured for attachment with the tensioning line of the anchor handling vessel. The system includes a fairlead stopper coupled with a floating vessel. The fairlead stopper includes a messenger line coupled therewith.

BRIEF DESCRIPTION OF THE DRAWINGS

So that the manner in which the features and advantages of the system, apparatus, products, and/or methods so of the present disclosure may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

FIG. 1C is a detail view of a tension coupler of the mooring line of FIG. 1A.

FIG. 1I is a side view of the AHV lowering a hold line to secure with the mooring line in the water.

FIG. 2D depicts a detail view of the fairlead stopper of FIG. 2A, with a mooring line being hauled-in.

FIG. 2I depicts the fairlead stopper of FIG. 2F, after the mooring line is fully hauled-in, including a deflector plate on the fairlead stopper upon which the bitter end may be routed and cut.

Systems, apparatus, and methods according to present disclosure will now be described more fully with reference to the accompanying drawings, which illustrate various exemplary embodiments. Concepts according to the present disclosure may, however, be embodied in many different forms and should not be construed as being limited by the illustrated embodiments set forth herein. Rather, these embodiments are provided so that this disclosure will be thorough as well as complete and will fully convey the scope of the various concepts to those skilled in the art and the best and preferred modes of practice.

DETAILED DESCRIPTION

Certain aspects of the present disclosure include methods, systems, and apparatus for mooring vessels and tensioning mooring lines.

Mooring with a Fairlead Stopper

Certain aspects of the present disclosure include methods, systems, and apparatus for mooring vessels and tensioning mooring lines using a fairlead chain stopper (also referred to as a fairlead or fairlead stopper) and an anchor handling vessel (AHV), such as an anchor handling tug supply (AHTS) vessel. In some such aspects, the vessels are moored and the mooring lines are tensioned without use of chain jacks, such as chain jacks positioned on the deck of the vessel, and without use of other dedicated on-vessel or off-vessel tensioning equipment. For example, and without limitation, the fairlead stoppers used herein may be fairleads in accordance with those disclosed in U.S. Pat. No. 5,845,893; 8,915,205; or 9,126,659; or may be fairleads in accordance with those disclosed in U.S. Patent Publication No. 2018/0086421; the entireties of each these patents and patent application are incorporated herein by reference. One exemplary fairlead suitable for use herein is the BARLATCH™ Fairlead Stopper by Bardex Corporation.

Exemplary Mooring Line Hook Up, Tensioning, and Stretching Procedure

Figures 1A, 1B:
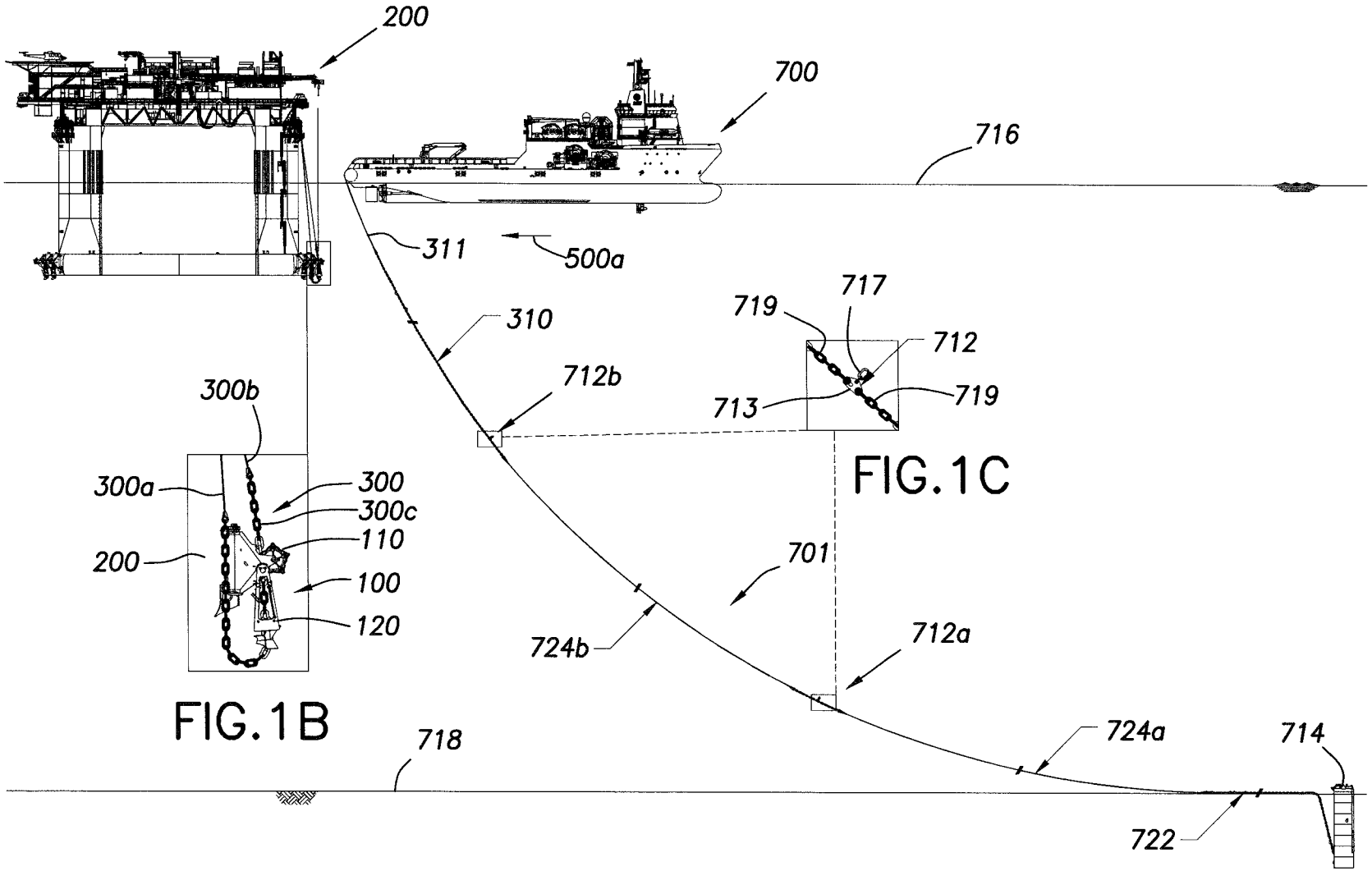
FIG. 1A is a side view of a work site where a floating vessel is positioned, prior to being moored using an AHV.
FIG. 1B is a detail view of a fairlead stopper of the floating vessel of FIG. 1A.

Certain aspects of the present disclosure include a mooring hook-up and tensioning procedure using a fairlead stopper. FIGS. 1A-1R depict a floating structure being moored in accordance with certain aspects of the present disclosure, and FIGS. 2A-21 depict detail views of fairlead stoppers used during the mooring of the floating structure. Steps of mooring the floating structure will now be described with reference to FIGS. 1A-1R and FIGS. 2A-21. The order of steps presented is just one possible sequence, and the order of steps may be determined depending on the particular mooring installation, conditions, and other variables. The elements throughout the Figures provided herein are not necessarily to scale, but are representative thereof. Also, throughout the Figures provided herein, like reference numerals refer to like elements.

Generally, some embodiments of the method disclosed herein include: (1) coupling a pre-reeved messenger line of a fairlead stopper on a vessel with a pre-laid mooring line and with a winch on an AHV; (2) hauling in the mooring line to a first pre-tension value (e.g., 250 metric tons) while maintaining the position of the AHV using a hold-back line that is coupled between the AHV and the mooring line, ensuring that the polyester segments of the mooring line, if used, are raised above the seafloor during the tensioning steps; (3) optionally proof loading the mooring line to, for example, 40% of the MBL of the stretchable (e.g., polyester) segments of the mooring line by applying tension using a tensioning line coupled between the AHV and the mooring line; and (4) tensioning the mooring line to a second pre-tension value (e.g., 300 metric tons).

Floating Vessel

With reference to FIG. 1A, the mooring method disclosed herein includes towing vessel 200 to a desired site. Vessel 200 may be any of various types of floating structures requiring mooring, such as an oil drilling or production platform, a floating production storage offloading (FPSO) vessel, an offshore floating wind power foundation, a floating fish farm, or any other offshore floating structure. The site may be the location at which vessel 200 is to be moored, such as the offshore location at which vessel 200 is to be used in oil drilling or production operations.

Anchor Handling Vessel

Also positioned at the site is anchor handling vessel, AHV 700. AHV 700 may be a ship including one or more winches, cranes, shark jaws, stern rollers, ROVs, and other devices that may be used in the mooring of a vessel.

Fairlead Stopper

Vessel 200 includes fairlead stopper 100 coupled therewith (e.g., coupled with the hull). Vessel 200 may include a plurality of fairlead stoppers 100. Fairlead stoppers 100 may be positioned along each side of vessel 200. The fairlead stoppers 100 may be positioned on vessel 200 above waterline 716, below waterline 716, or combinations thereof.

Figure 2B:
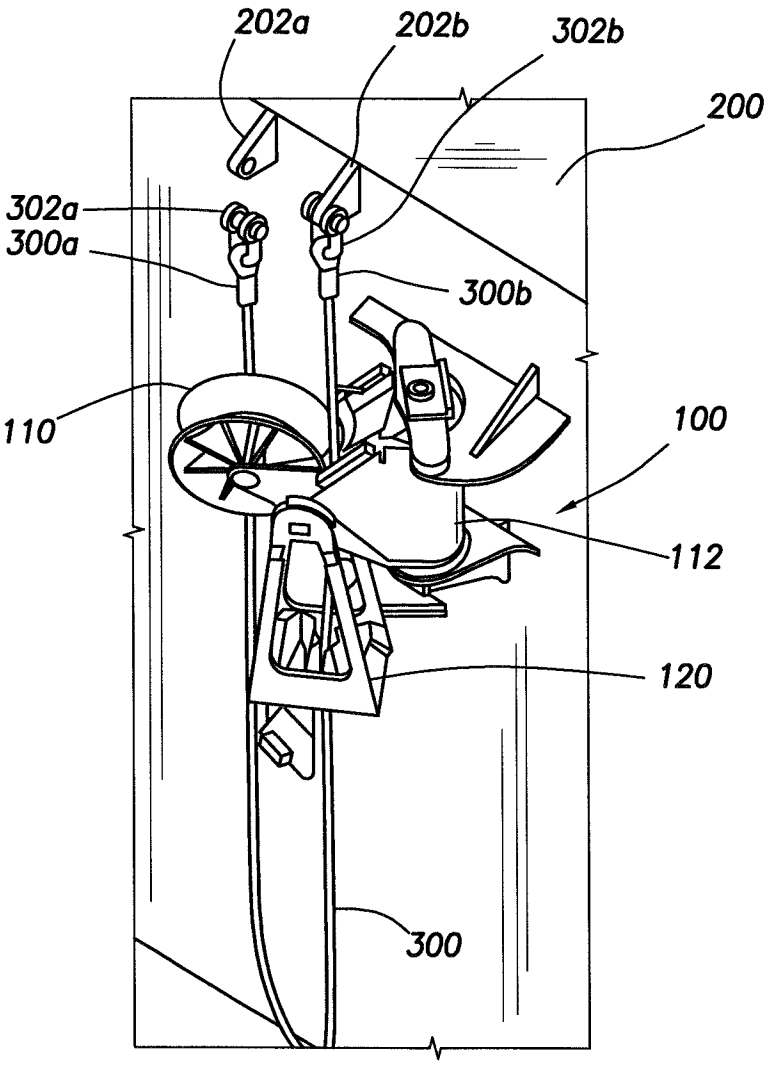
FIG. 2B depicts the fairlead stopper of FIG. 2A, with a first end of the messenger line decoupled from a pad eye on the floating structure.
Figure 2A:
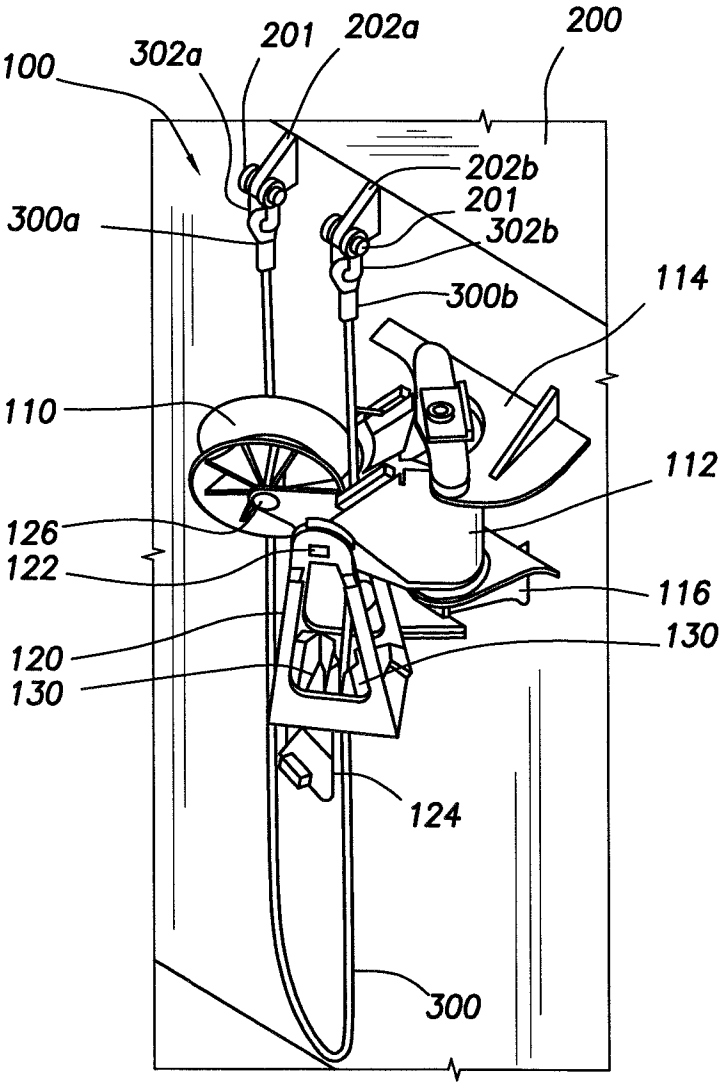
FIG. 2A depicts a detail view of a fairlead stopper, including a pre-reeved messenger line that is coupled, at both ends, to pad eyes on the floating structure.

With reference to FIG. 2A, fairlead stopper 100 is shown positioned and arranged in a manner suitable for transport of vessel 200. For example, fairlead stopper 100 may be in the position and arrangement shown in FIG. 2A from a time at which vessel 200 is at a dock, throughout transport of vessel 200 from the dock to the site, and while positioned at the site prior to beginning the mooring of vessel 200 (e.g., as shown in FIG. 1A).

Figure 2D:
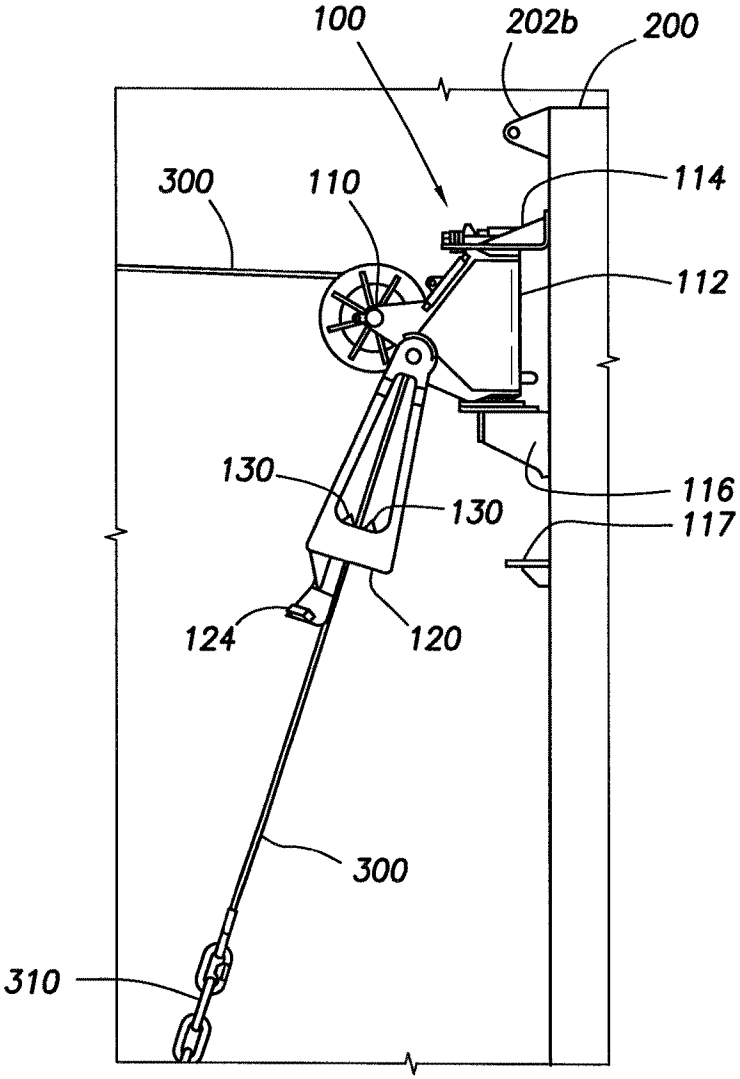

Fairlead stopper 100 includes fairlead housing 112 coupled with vessel 200 via brackets 114 and 116. Fairlead housing 112 may be movably (e.g., pivotably) coupled with brackets 114 and 116, such as via pins. Fairlead stopper 100 includes latch housing 120, which may be movably (e.g., pivotably) coupled with fairlead housing 112, such as via pin 122. Latch housing 120 may include guide member 124 for guiding lines (e.g., ropes, chains, and other such lines) into and out of latch housing 120. Latches 130 may be positioned within latch housing 120, and arranged for engagement with chains or other lines passing through latch housing 120. Fairlead stopper 100 includes chainwheel 110, which may be movably (e.g., pivotably) coupled with fairlead housing 112, such as via axle 126. Chainwheel 110 may be positioned to engage with lines (e.g., ropes, chains, and other such lines) for moving, guiding, or otherwise facilitating movement of such lines through fairlead housing 112 and latch housing 120. In some aspects, latch housing 120 or another portion of fairlead stopper 100 may be temporarily secured to vessel 200 during transport, such as to bracket 117 on vessel 200 (as shown in FIG. 2D). The fairlead stoppers disclosed herein are not limited to the particular structures shown in FIGS. 2A-21, and may be any of various structures capable of moving or facilitating movement of mooring lines and securing a position of mooring lines for tensioning thereof and for mooring a floating vessel.

As shown in FIG. 2A, fairlead stopper 100 may be pre-reeved with messenger line 300. That is, fairlead stopper 100 may have messenger line 300 that is at least partially engaged therewith. Pre-reeving of fairlead stopper 100 with messenger line 300 may be performed at port, prior to vessel 200 departing the port for site. A lower end of messenger line 300 is looped up from below fairlead stopper 100 to pad eye 202*a* on the hull of vessel 200. As shown in FIG. 2A, messenger line 300 is run through fairlead housing 112 adjacent chainwheel 110, and is run through latch housing 120, passing between latches 130 and adjacent guide member 124. Messenger line 300 may be a chain, rope, polymer line, wire, or another type of line. First end 300*a* and second end 300*b* of messenger line 300 may each be coupled with vessel 200 during transport. As shown, first end 300*a* and second end 300*b* include shackles 302*a* and 302*b*, respectively, for coupling with pad eyes 202*a* and 202*b* via pins 201, respectively. Pad eyes 202*a* and 202*b* may be positioned on vessel 200 (e.g., welded thereto). However, messenger line 300 is not limited to being coupled to vessel 200 via shackles and pad eyes, and may be coupled to vessel 200 via other structures. Furthermore, messenger line 300 may be, instead, coupled with a portion of fairlead stopper 100 or another structure rather than being coupled with vessel 200. Regardless of the particular structure which messenger line 300 is coupled with, one or both ends of messenger line 300 may be secured during transport of vessel 200. While shown as positioned below waterline 716, in some aspects, fairlead stopper 100 is located above waterline 716. Fairlead stopper 100 may be an underwater chain stopper fairlead (UCSF). In some such aspects, pad eyes 202*a* and 202*b* may be located below fairlead stopper 100 such that a remotely operated vehicle (ROV) or diver may access messenger line 300 for coupling thereof with lines and/or winches of AHV 700. In other aspects, one end of messenger line 300 may be coupled to a counterweight, securing the counterweight to the hull of vessel 200 or to fairlead stopper 100.

With reference to FIGS. 1A-1C, the method includes releasing the sea-fastening of fairlead stopper 100, such as by disconnecting fairlead stopper 100 from bracket 117 (shown in FIG. 2D) such that fairlead stopper 100 is positioned for operation. As shown in FIG. 1B, messenger line 300 includes first end 300*a* and second end 300*b*, each of which may be at least partially composed of metal or polymer wire or rope, or another material. As discussed with reference to FIG. 2A, each of first end 300*a* and second end 300*b* may be coupled with a hull of vessel 200. Messenger line 300 also includes intermediate segment 300*c*, which may be at least partially composed of a chain (e.g., a steel chain). With first end 300*a* and second end 300*b* coupled with the hull of vessel 200, intermediate segment 300*c* is reeved through latch housing 120 and adjacent chainwheel 110. First and second ends (or segments) 300*a* and 300*b* of messenger line 300 may be wires of a non-rotating construction, mitigating the introduction of twists into top chain 310.

AHV 700 is moved into position relative to floating vessel 200 (e.g., by moving in direction 500*a*). As shown in FIG. 1A, AHV 700 includes work-line 311, which is coupled with a winch on AHV 700. As AHV 700 moves into position relative to floating vessel 200, AHV 700 pays out work-line 311 as needed. The method includes paying out work-line 311 to retrieve mooring line 701 from seafloor 718. While paying out work-line 311, AHV 700 maintains station using minimal thrust and maintains proper rudder clearances from vessel 200. Work-line 311 is then coupled with top chain 310, such as via a shackle. This operation may be facilitated by a diver or ROV. After work-line 311 is coupled with top chain 310, work-line 311 may be hauled-in toward AHV 700, such that mooring line 701 is at least partially lifted off of seafloor 718 towards AHV 700. While shown and described as using a work line, 311, in some aspects a work line is not used, such as in shallow water operations. In some such aspects, a winch wire is paid to retrieve mooring line 701.

Mooring Line

Mooring line 701 may include one or more sections of line, each of which may be composed of the same material or of different materials. The various segments of mooring line 701 may be coupled together via shackles, H-Links or other connectors. Mooring line 701 includes bottom chain 722, which may be a pile forerunner, coupled with anchor 714 at seafloor 718. Anchor 714 may be a suction pile, driven pile, drag embedment anchor, gravity anchor, torpedo anchor, or another type of anchor positioned at seafloor 718. Mooring line 701 includes a midspan mooring line coupled with bottom chain 722. In FIG. 1A, the midspan mooring line includes two individual segments of polyester line, 724*a* and 724*b*. Midspan line 724*a* is coupled with bottom chain 722, such as via a shackle. Midspan line 724*b* is coupled with midspan line 724*a* via tension coupler 712*a*. Midspan lines 724*a* and 724*b* may be rope, chain, or polymer lines. Mooring line 701 may be pre-laid and wet stored on seafloor 718 at the site, prior to towing vessel 200 to the site, or may be laid on seafloor 718 after towing vessel 200 to the site.

In some aspects, midspan lines 724*a* and 724*b* may include, at least partially, polyester, metal, composite material, or another material. As described in more detail below, in some aspects, materials, such as polyester or other polymers, are subjected to a stretching step in the mooring process. The stretching step may be performed after mooring line 701 has been connected to vessel 200 and pre-tensioned. The mooring lines disclosed herein are not limited to the particular, exemplary structure shown in FIG. 1A, and may include different numbers of line segments and/or be composed of different materials.

Tension Couplers

As shown in FIG. 1C, tension coupler 712 includes a plate 713 coupled with connection chains 719 for coupling with both midspan lines 724*a* and 724*b* together. Also, shackle 717 is coupled with plate 713 for coupling with a tensioning line (not shown). Midspan line 724*b* is coupled with top chain 310 (e.g., steel chain) via tension coupler 712*b*, which may be identical to tension coupler 712*a*. In operation, tension coupler 712*b* may be used to couple with a winch line of AHV 700 for holding a position of AHV 700 during mooring line 701 tensioning, and tension coupler 712*a* may be used to couple with a winch line of AHV 700 for stretching of mooring line 701.

Tension couplers 712*a* and 712*b* are coupled at positions along the length of mooring line 701. As shown in FIG. 1A, tension coupler 712*b* is coupled between midspan 724*a* and top chain 310, and tension coupler 712*a* is coupled between midspan lines 724*a* and 724*b*. However, the tension couplers disclosed herein may be coupled at other locations along mooring line 701, such as in bottom chain 722, in midspans 724*a* and 724*b*, between bottom chain 722 and midspan 724*a*, between midspan 724*b* and top chain 310, or another location along mooring line 701. Tension couplers 712*a* and 712*b* may be a structure capable of coupling two, three, or more lines, ropes, wires, or chains together, as well as providing a point along the length of mooring line 701 at which tension may be applied to mooring line 701 (as shown and described in more detail below). In some aspects, if midspans 724*a* and 724*b* are or includes rope, tension coupler 712*a* may be used to stretch the rope, as needed, by pulling upwards on tension coupler 712*a* in a manner similar to the plucking of a "bow string" after pre-tensioning mooring line 701 is completed. In some aspects, tension couplers 712*a* and 712*b* include a steel plate with through-holes positioned therethrough.

Coupling the Messenger Line with the Mooring Line

Figure 1D:
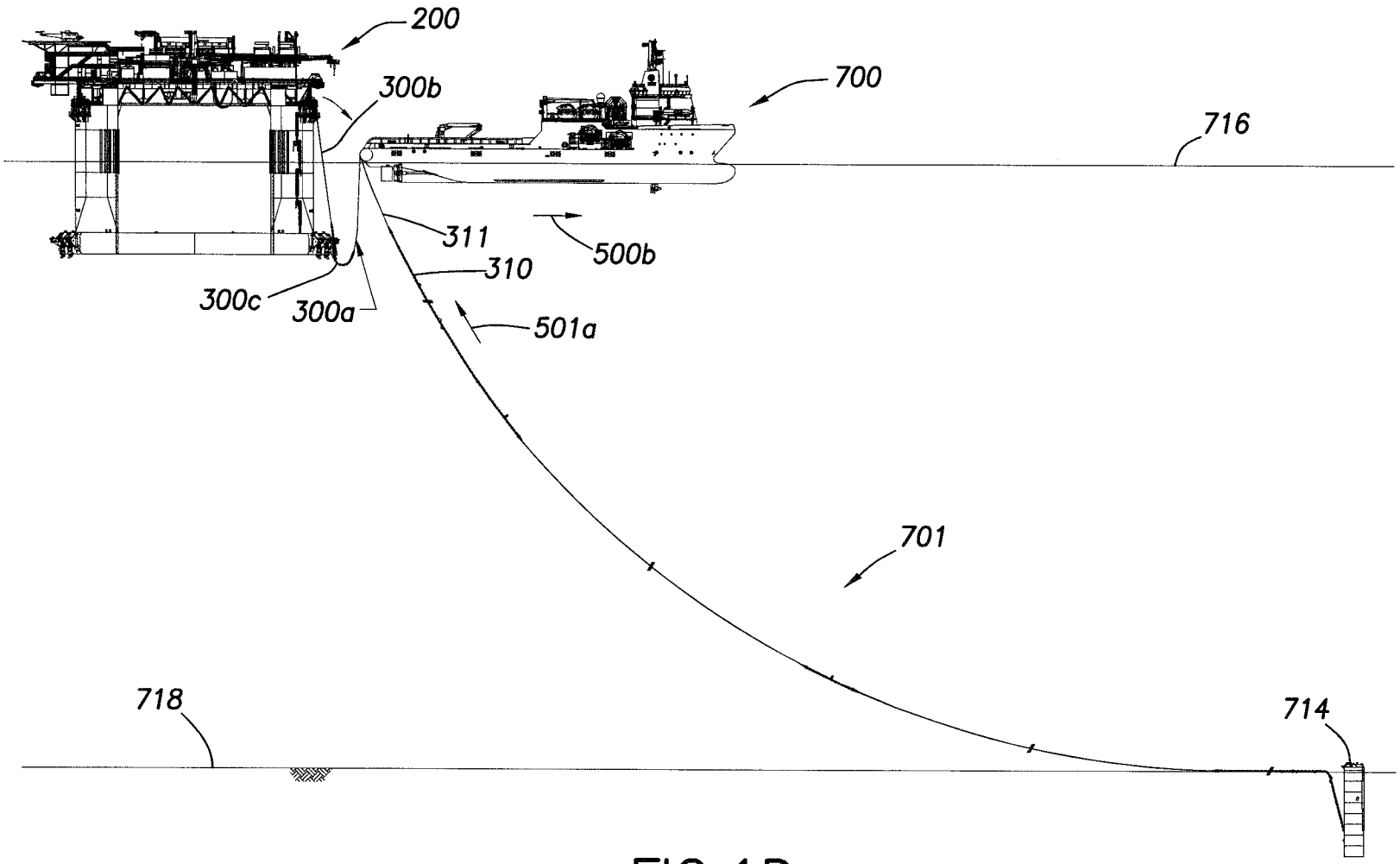
FIG. 1D is a side view the AHV of FIG. 1A retrieving a messenger line from the fairlead stopper on the vessel.

Turning now to FIG. 1D, after AHV 700 is moved into position relative to vessel 200, the method includes retrieving first end 300*a* of the messenger line from vessel 200, and securing first end 300*a* of the messenger line on AHV 700 (e.g., securing first end 300*a* of the messenger line in shark jaws of AHV 700). For example, with reference to FIG. 2B, first end 300*a* may be removed from pad eye 202*a* by removing the associated pin 201. This may be performed by a diver, ROV, from the deck, or in another manner.

Once first end 300*a* of the messenger line is secured on AHV 700 (e.g., in shark jaws), the method includes moving AHV 700 away from vessel 200 (e.g., along direction 500*b*) to a location suitable for connecting first end 300*a* with top chain 310. In some such aspects, while AHV 700 is moving away from vessel 200, the method includes hauling-in mooring line 701 by hauling-in work-line 311 (e.g., along direction 501*a*).

Figure 1F:
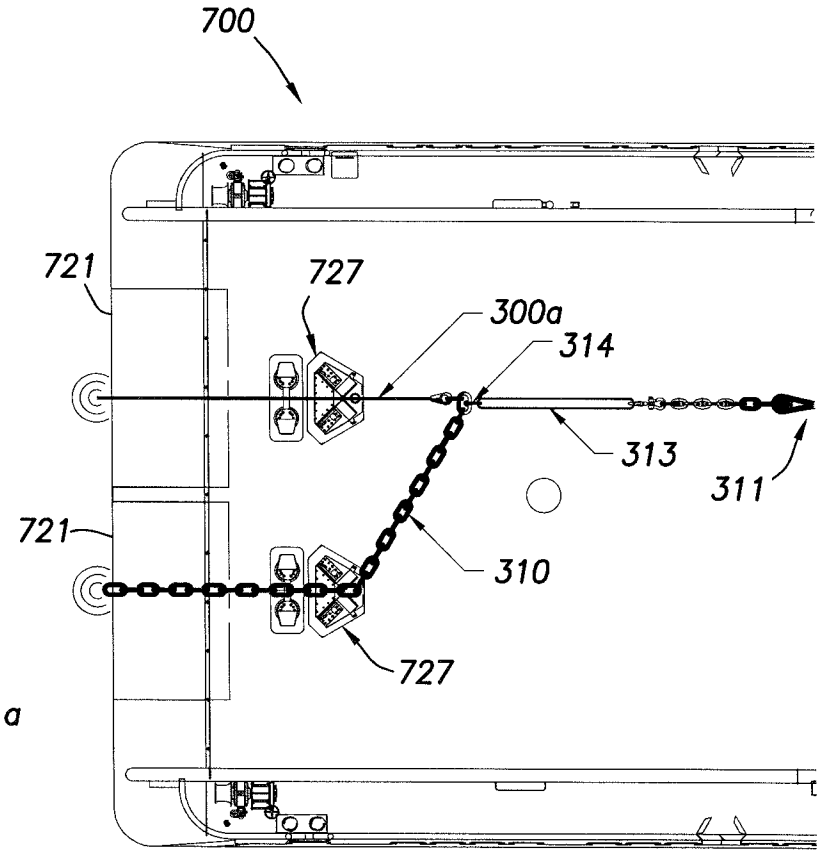
FIG. 1F is a top view of a portion of the AHV with the mooring line and messenger line secured to the AHV.
Figure 1E:
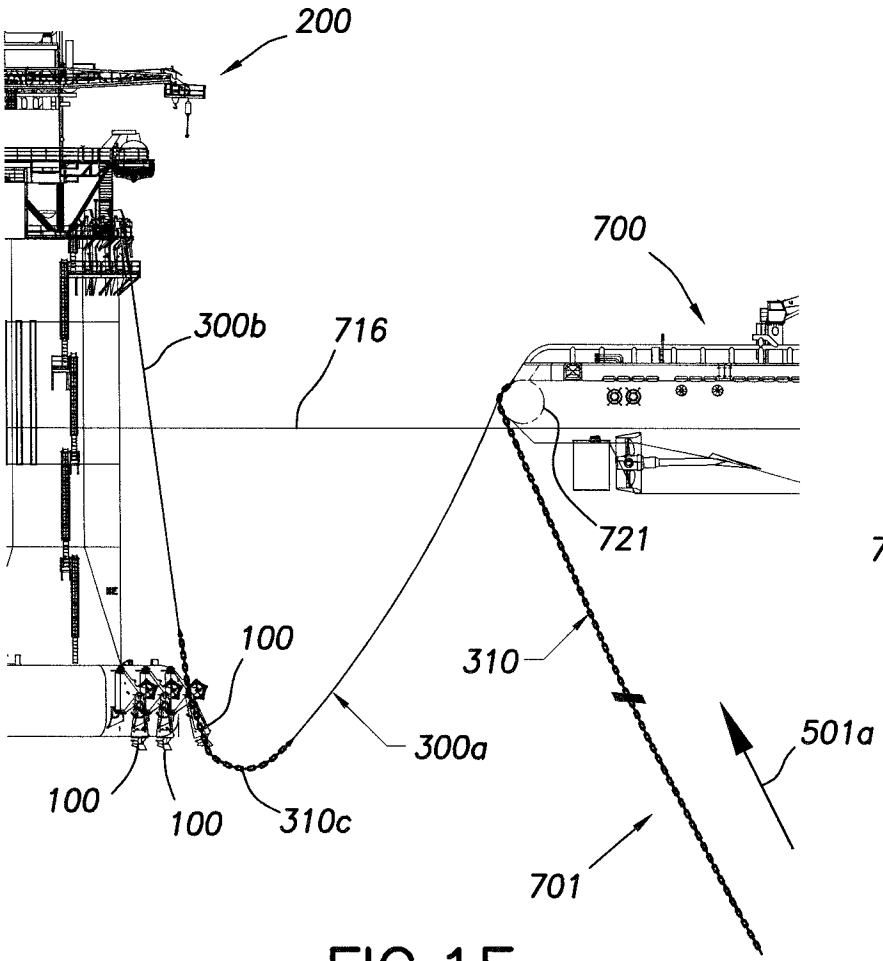
FIG. 1E is a side view of the AHV of FIG. 1D with the mooring line and messenger line secured to the AHV.

Turning now to FIGS. 1E and 1F, the method includes hauling in mooring line 701 over stern roller 721 until top chain 310 is secured on deck of AHV 700, such as in a shark jaw 727. The method also includes hauling in first end 300*a* over another stern roller 721 and securing first end 300*a* on the deck of AHV 700, such as in another shark jaw 727. With first end 300*a* of the messenger line and top chain 310 secured in shark jaws 727, rigging 313 (e.g., A & R rigging) is coupled with top chain 310 and first end 300*a* for the overboarding of mooring line 701. Rigging 313 is coupled with first end 300*a* and top chain 310 via ROV shackle 314. In some aspects, AHV 700 maintains position, with minimal thruster assistance, during connection of top chain 310 with first end 300*a*.

Figure 1G:
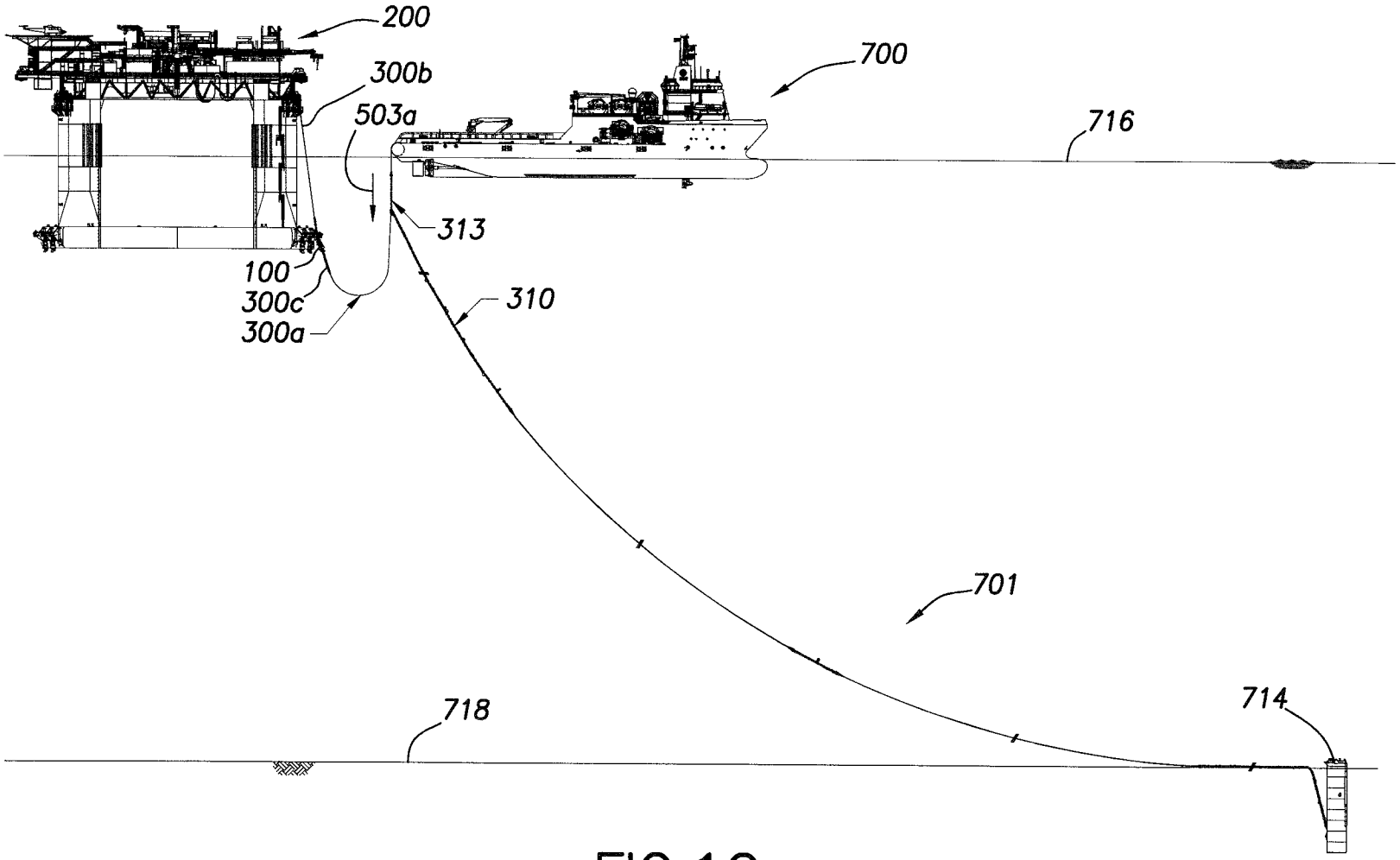
FIG. 1G is a side view of the AHV with the connected mooring line and messenger line being lowered into the water.

Turning now to FIG. 1G, the method includes lowering first end 300*a* and top chain 310, coupled together via rigging 313, overboard (e.g., along direction 503*a*) into the water. After lowering first end 300*a* and top chain 310 into water, rigging 313 is disconnected therefrom, such as via use of an ROV. Rigging 313 may then be recovered to the deck of AHV 700. Once first end 300*a* and top chain 310 and rigging 313 is disconnected therefrom, fairlead stopper 100 bears the load of mooring line 701 (via the latches of fairlead stopper 100).

Coupling the Messenger Line with the AHV

Figure 1H:
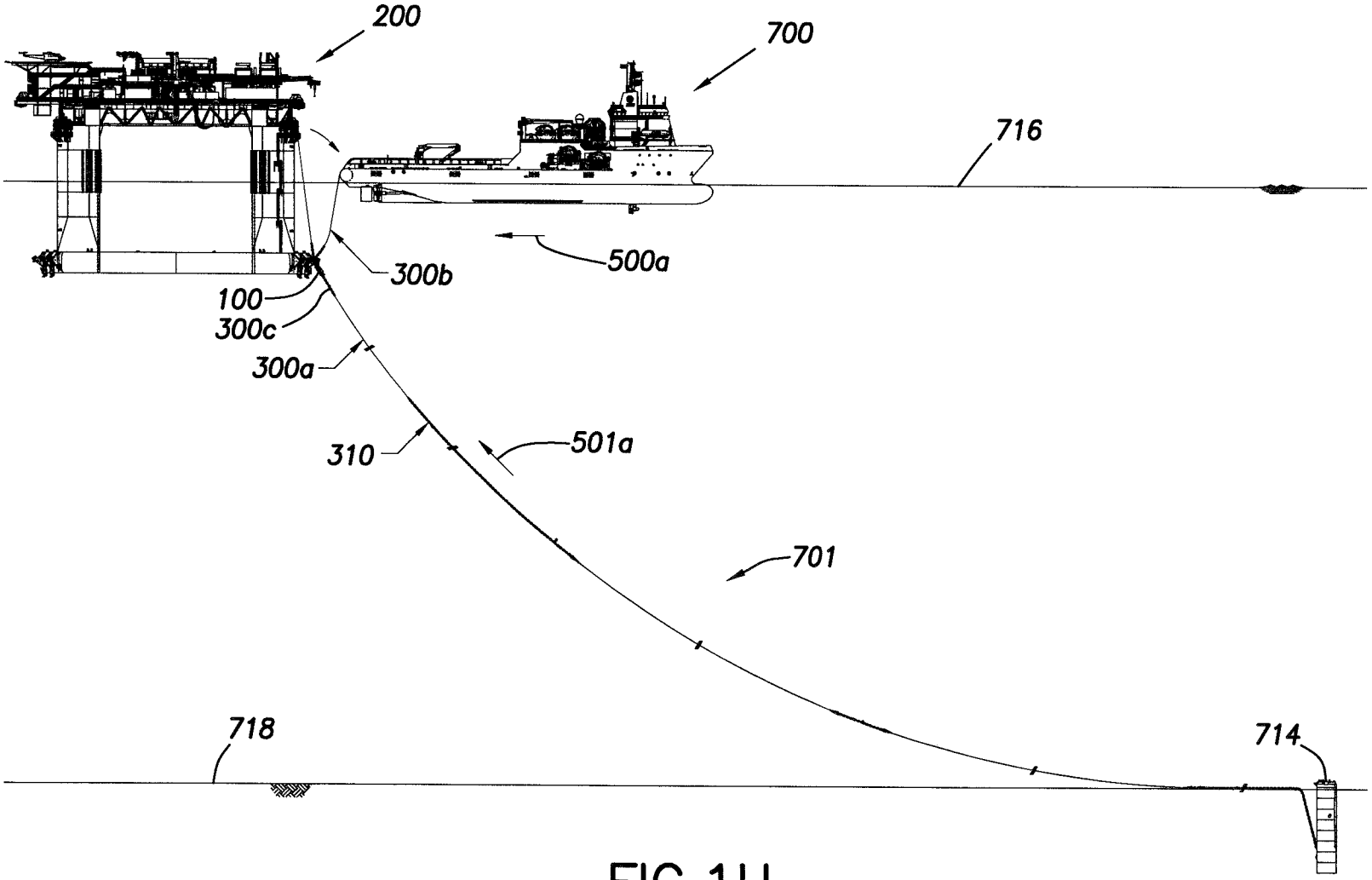
FIG. 1H is a side view of the AHV retrieving the other end of the messenger line.
Figure 11:
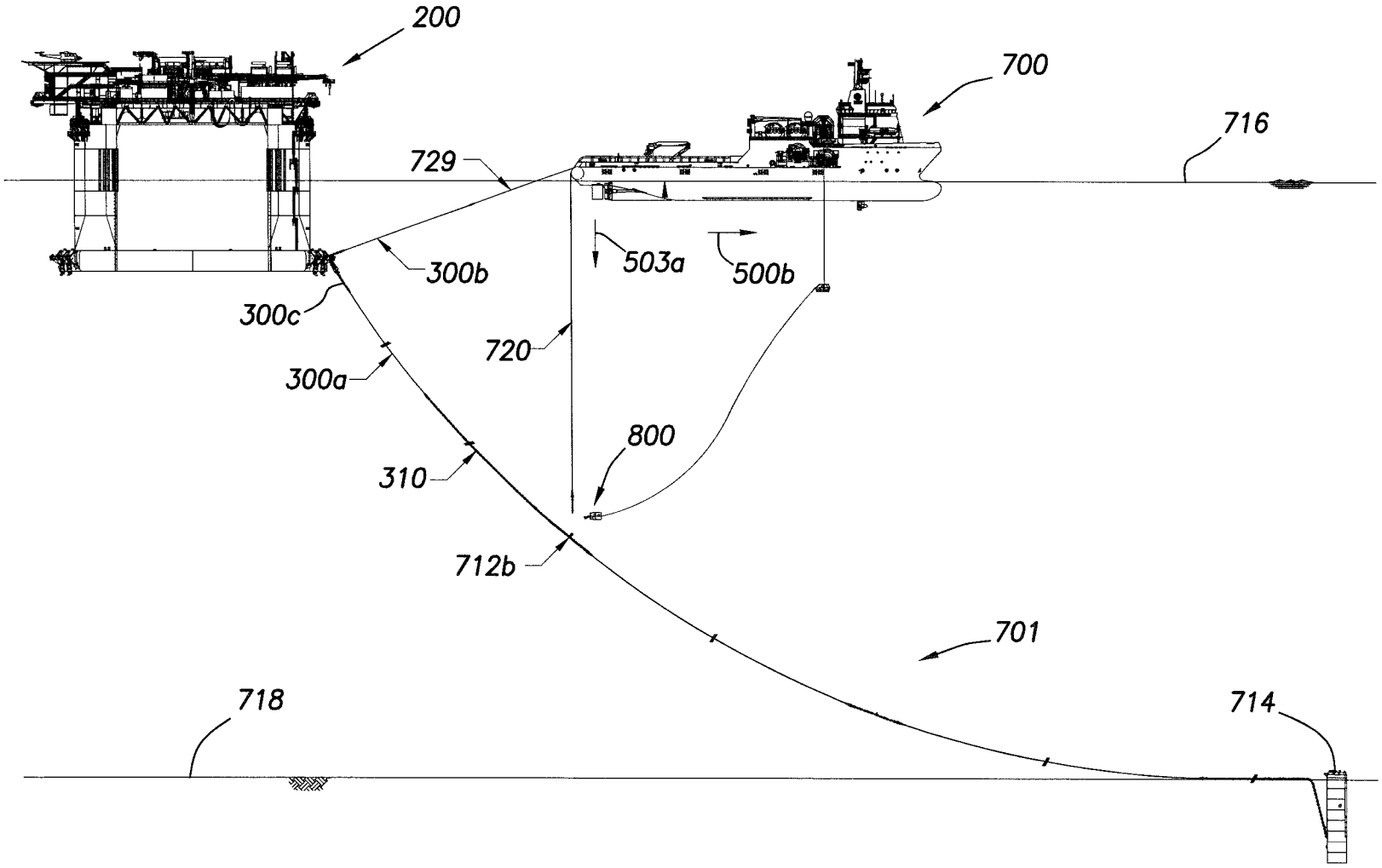
Figure 2C:
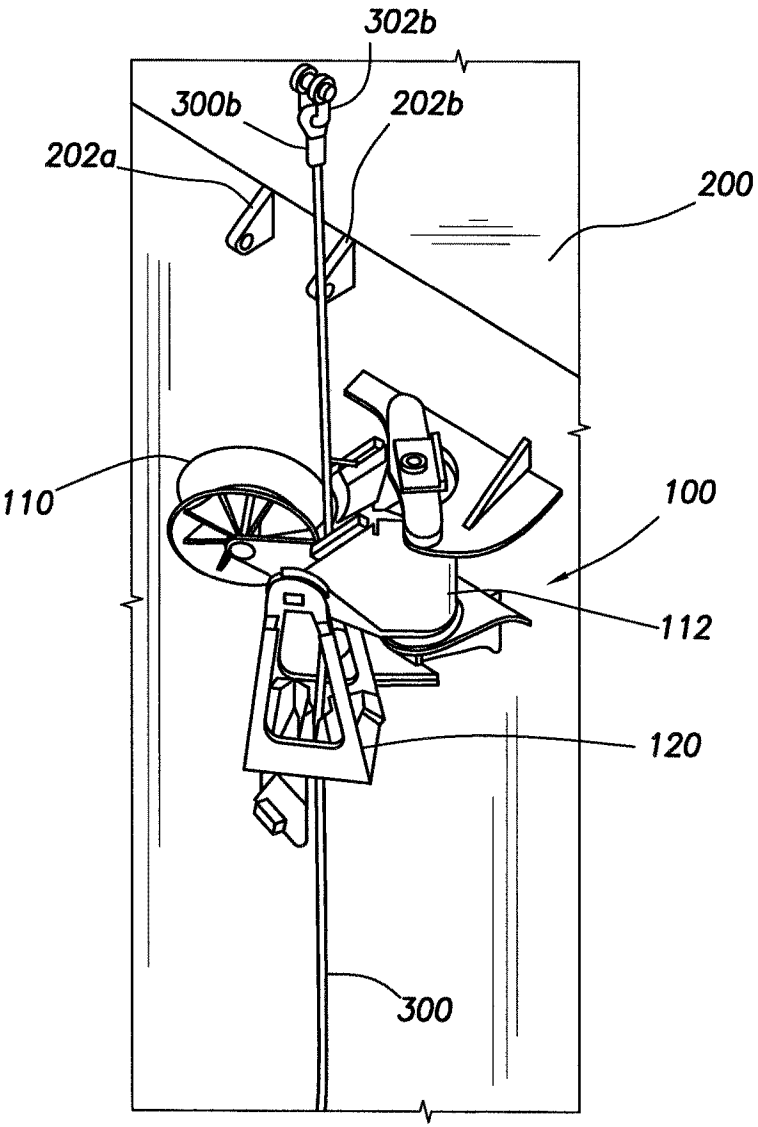
FIG. 2C depicts the fairlead stopper of FIG. 2B with a second end of the messenger line decoupled from a pad eye on the floating structure.

Turning now to FIG. 1H, with the fairlead stopper 100 bearing the load of mooring line 701, the method then includes moving AHV 700 into position to receive second end 300*b* of the messenger line, such as via moving AHV 700 towards vessel 200 along direction 500*a*. Once AHV 700 is in position, the method includes passing second end 300*b* to AHV 700 and securing second end 300*b* to a winch on AHV 700. For example, as shown in FIG. 2C, second end 300*b* may be removed from pad eye 202*b* by removing the associated pin 201. Second end 300*b* of messenger wire 300 may then be coupled with a winch on AHV 700.

Coupling the AHV with the Mooring Line

Turning now to FIG. 1I, with second end 300*b* secured to a winch on AHV 700 via winch line 729 and/or secured in a shark jaw on AHV 700, the method includes moving AHV 700 to a position above tension coupler 712*b* (e.g., moving along direction 500*b*), while paying out a winch line, tension line 720 (also referred to as a hold line or hold-back line), from a winch on AHV 700 (e.g., moving along direction 503*a*). The method includes lowering tensioning line 720 towards tension coupler 712*b*. Tensioning line 720 may include a hook or other coupler for connecting with shack 717 of tension coupler 712*b*. ROV 800, deployed from AHV 700, may observe and/or facilitate the coupling of tensioning line 720 with tension coupler 712*b*.

Figure 1J:
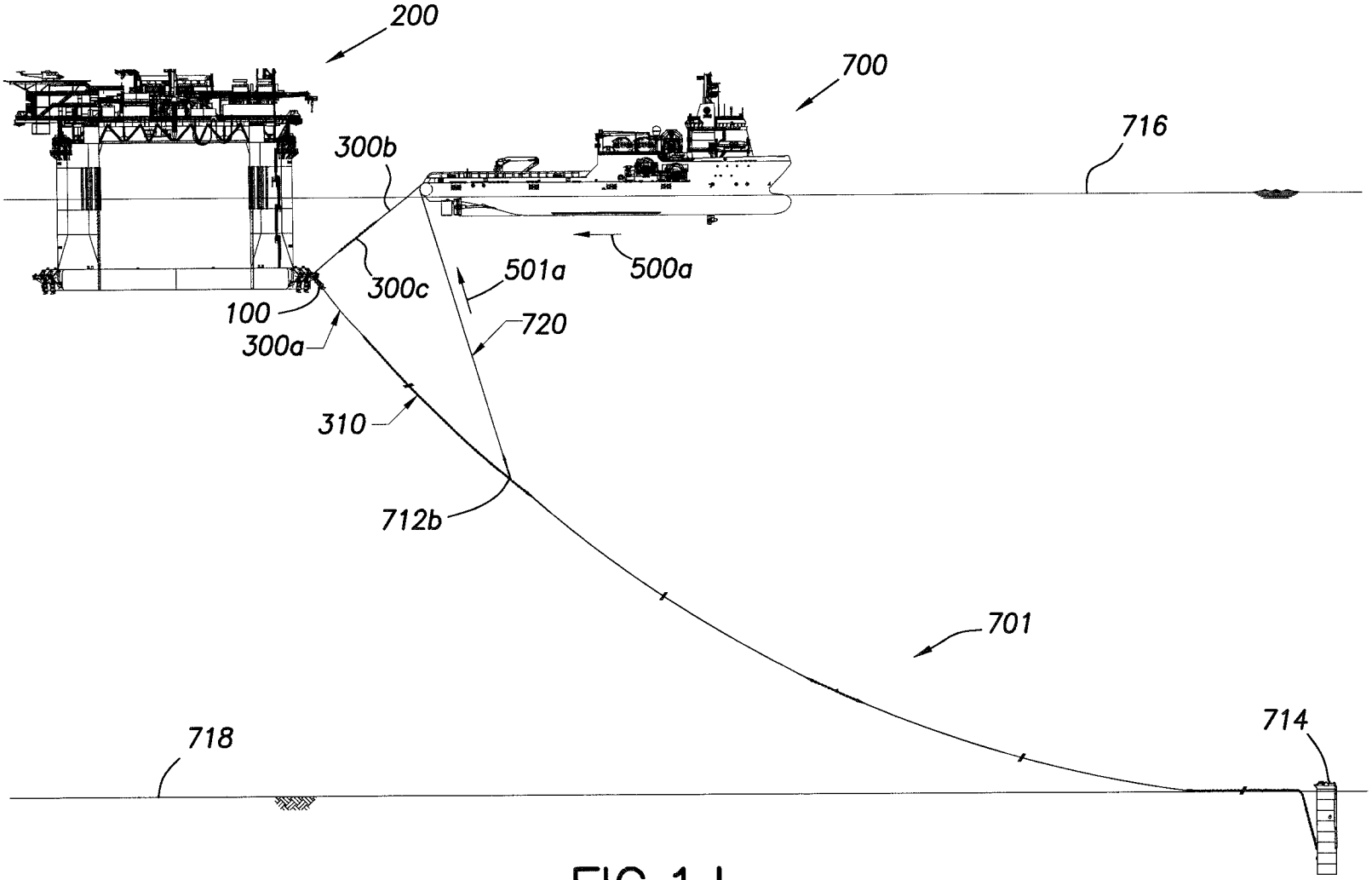
FIG. 1J is a side view of the AHV hauling in the mooring line and the hold line.

Turning now to FIG. 1J, with tensioning line 720 coupled to tension coupler 712*b*, the method includes hauling in tensioning line 720 to a desired degree of payout using a winch on AHV. Also, second end 300*b* is hauled in via another winch on AHV 700. Hauling in second end 300*b* ultimately pulls in top chain 310 through fairlead stopper 100 and into engagement with the latches thereof. Hauling in tensioning line 720 facilitates holding AHV 700 in position while AHV 700 hauls in mooring line 701. In some such aspects, tension coupler 712*b* is positioned far enough away from vessel 200 that there is a significant horizontal load exerted on AHV 700 pulling it away from vessel 200 when tensioning line 720 is hauled in, counteracting an opposite horizontal load exerted on AHV 700 from pulling on messenger line 300 and/or top chain 310. In some such aspects, the tension applied to tensioning line 720 causes a force on AHV 700 directed away from vessel 200 that is sufficient to counteract force on AHV 700 directed toward vessel 200 (caused by hauling in mooring line 701), such that these forces on AHV 700 are equilibrated and AHV 700 maintains station without use of thrusters or with minimal use of thrusters.

Tensioning Mooring Line

Figure 1L:
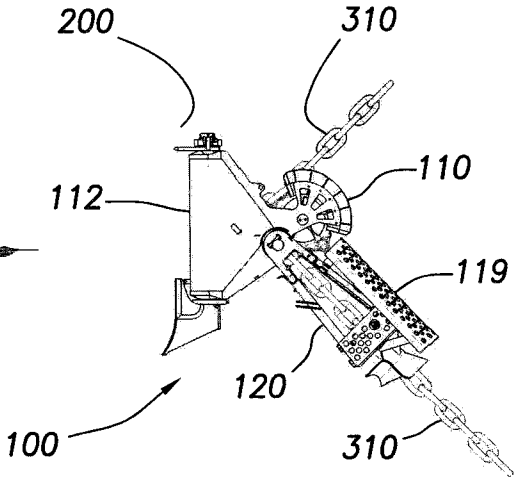
FIG. 1L is a detail view of the fairlead stopper of FIG. 1K during hauling in of the mooring line.
Figure 1K:
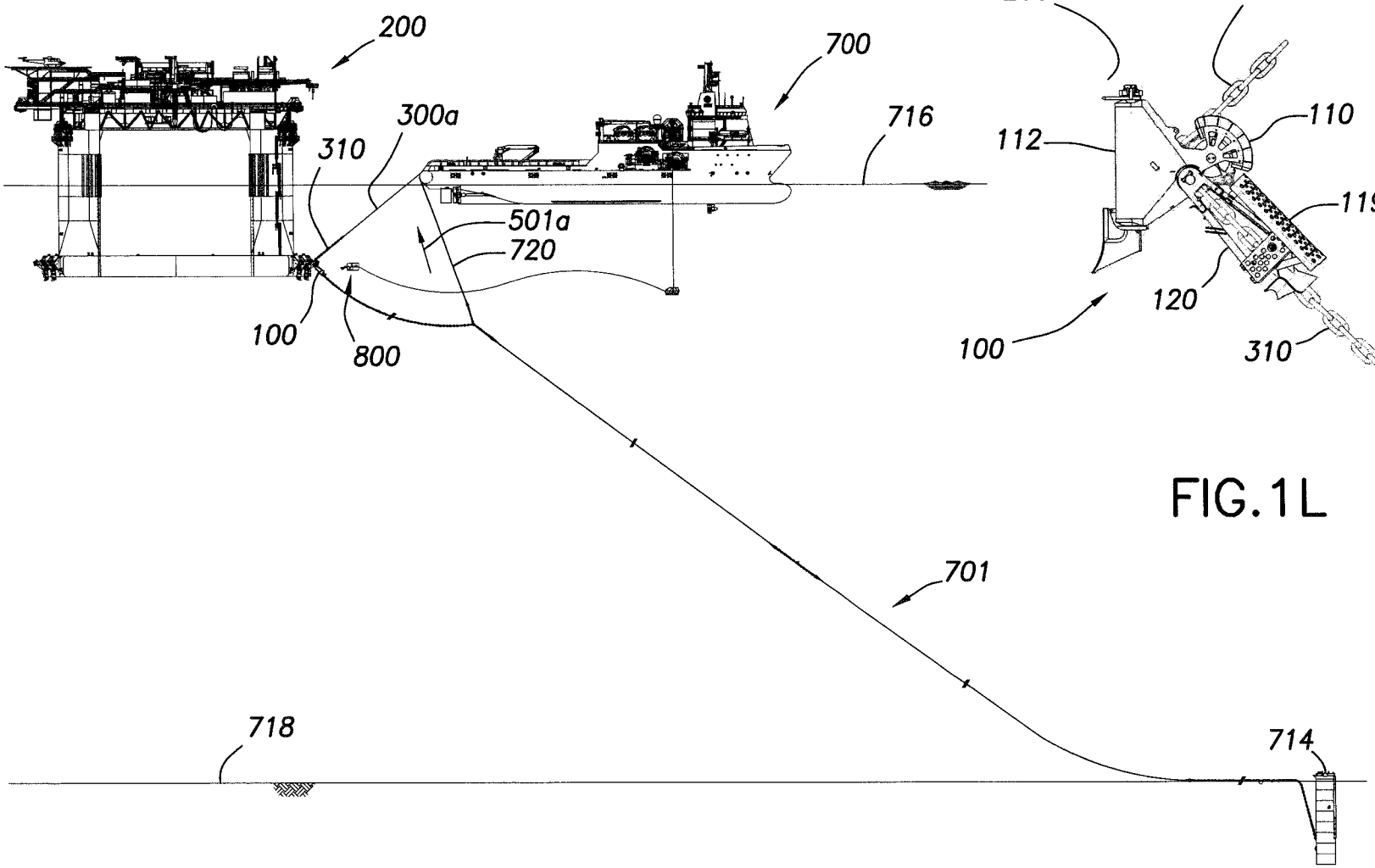
FIG. 1K is a side view showing an ROV monitoring the hauling in of the mooring line.

Turning now to FIGS. 1K and 1L, the method includes continuing to haul in top chain 310 until the desired link of top chain 310 is secured via latches of fairlead stopper 100. Securing the desired link of top chain 310 with latches of fairlead stopper 100 may be indicative of the desired pretension on mooring line 701 being attained. In some such aspects, ROV 800 monitors top chain 310 as top chain 310 passes through fairlead stopper 100. In certain aspects, the desired link of top chain 310 is marked (e.g., painted), such that ROV 800 may visually observe when the desired link of top chain 310 is secured via latches of fairlead stopper 100. Upon observation that the desired link of top chain 310 is secured via latches of fairlead stopper 100, the method may include ceasing the hauling in of mooring line 701.

AHV 700 is capable of maintaining position with minimal thruster assist during hauling in of mooring line 701. AHV 700 maintains an equilibrium position, where horizontal load components from tensioned top chain 310 are counteracted by horizontal load components provided by line 720.

Figure 2E:
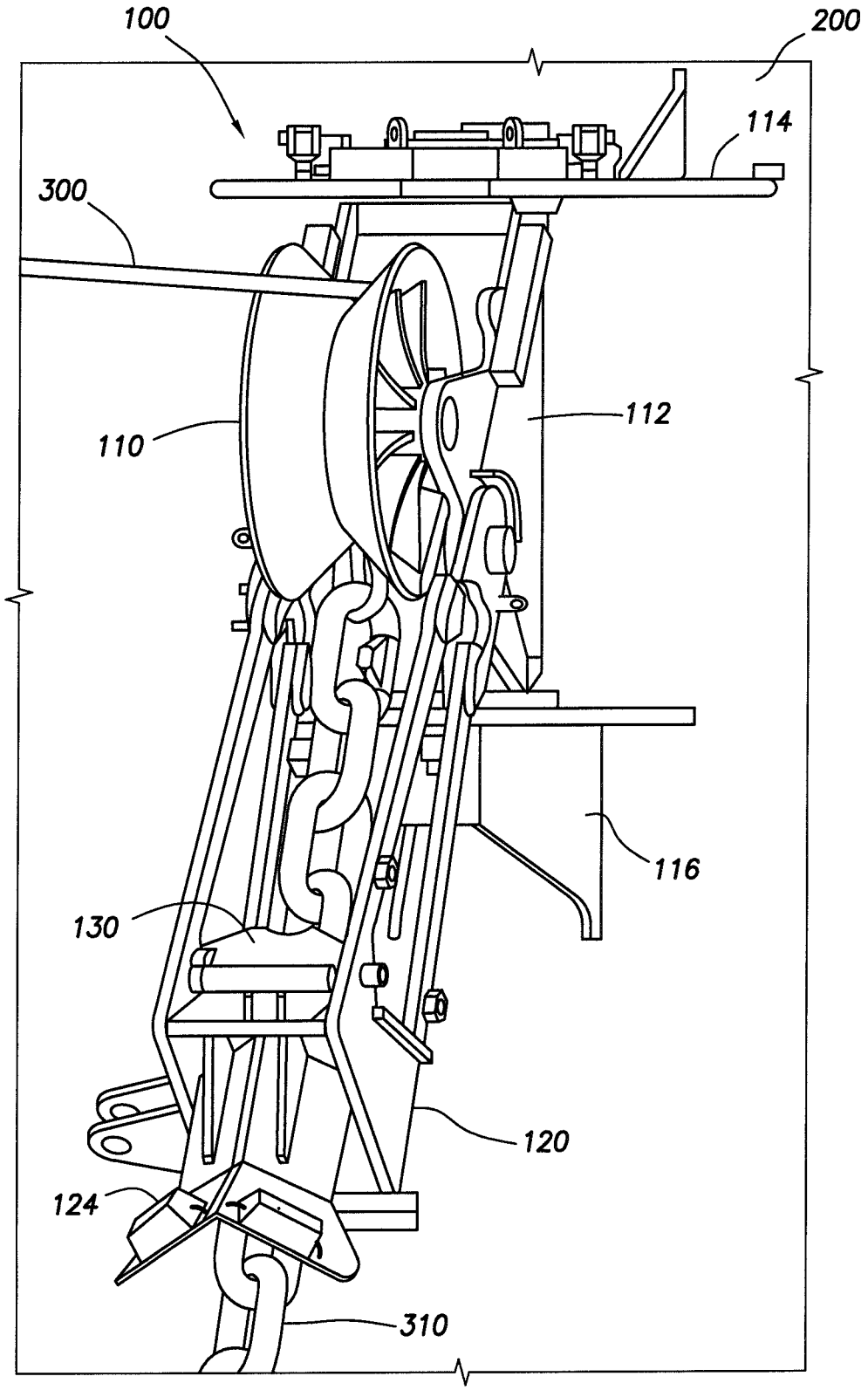
FIG. 2E depicts the fairlead stopper of FIG. 2D, with the mooring line further hauled-in relative to FIG. 2D, with the mooring line engaged with latches of the fairlead stopper.

Messenger line 300 and top chain 310 are hauled in through fairlead stopper 100, via pulling on messenger line 300 using a winch on AHV 700. As shown in FIG. 2D, messenger line 300 progresses through fairlead stopper 100 as top chain 310 approaches engagement with fairlead stopper 100 until links of top chain 310 are pulled into and through fairlead stopper 100. As top chain 310 passes through fairlead stopper 100, links of top chain ratchetedly engage with latches 130 of fairlead stopper, as shown in FIG. 2E. In some aspects, while hauling in mooring line 701 using a winch, AHV 700 also hauls in tensioning line 720 using a second winch on AHV 700 to provide a restoring force such that use of thrusters to provide a restoring force is not required, or such that the thrusters are at least assisted by the horizontal force component tending to pull AHV 700 away from vessel 200.

Figure 2F:
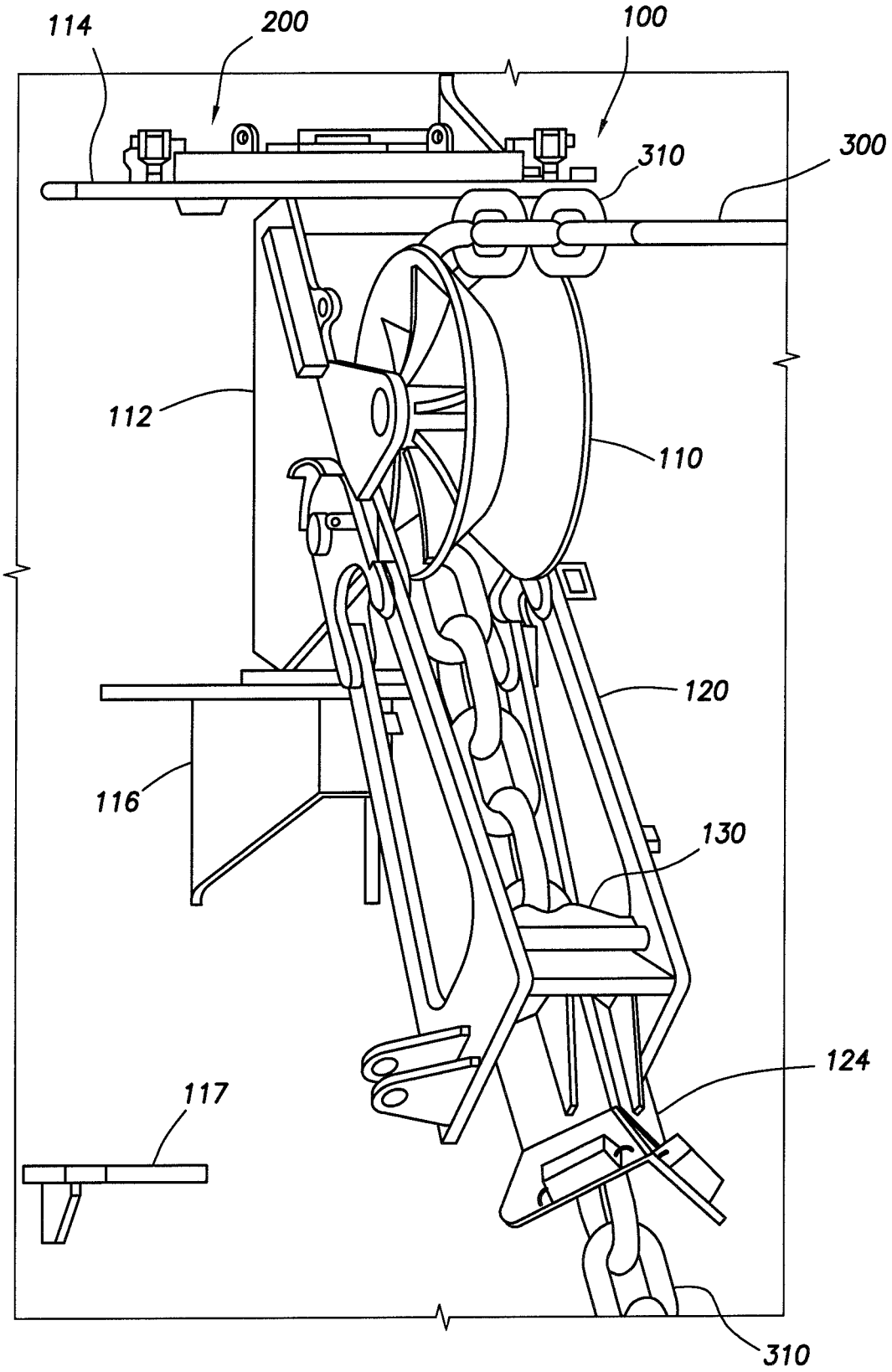
FIG. 2F depicts the fairlead stopper of FIG. 2E, with the mooring line further hauled-in relative to FIG. 2E, with the mooring line engaged with latches and a chainwheel of the fairlead stopper.

AHV 700 continues to pull top chain 310 through fairlead stopper 100 and over chainwheel 110, as shown in FIG. 2F, until a proper, desired pretension is achieved on mooring line 701. In some aspects, latches 130 on fairlead stopper 100 may be configured to automatically ratchet, closing on every link or every other link that passes through such that there is no need to manually operate latches 130. In some aspects, latches 130 may be configured to remain open while top chain 310 passes through fairlead stopper 100, and then to close when top chain 310 is tensioned to the desired level. Thus, the mooring method includes continuing to pull top chain 310 until mooring line 701 is tightened to the desired level. Depending on how much tail chain is present upon reaching the desired level of tension, the top chain-to-messenger line connection may be disconnected on AHV 700 or on vessel 200 deck. Once tensioned, latches 130 remain closed about at least one link of top chain 310 (sometimes referred to as the "golden link") to secure and maintain tension on mooring line 701.

In some aspects, during tensioning by pulling on messenger line 300, the method includes simultaneously pulling on tensioning line 720, thus pulling on tension coupler 712*b* and mooring line 701, which hauls in catenary weight, holding AHV 700 in a position away from vessel 200 and reduces load on messenger line 300 being pulled by winch. In some aspects, the simultaneous hauling in of mooring line 701 while pulling on mooring line 701 with line 720 provides equalized or substantially equalized horizontal force on AHV 700, allowing AHV 700 to maintain station. In some such aspects, propulsion using thrusters of the AHV 700 is used for station keeping of AHV 700.

Figure 1N:
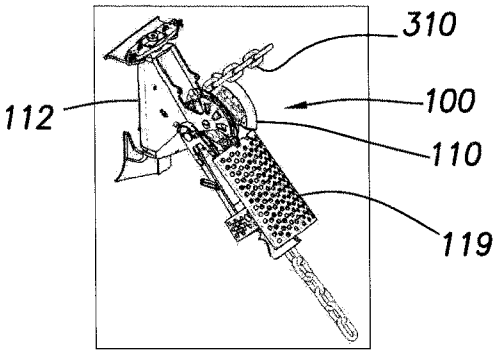
FIG. 1N is a detail view of the fairlead stopper of FIG. 1M.
Figure 1O:
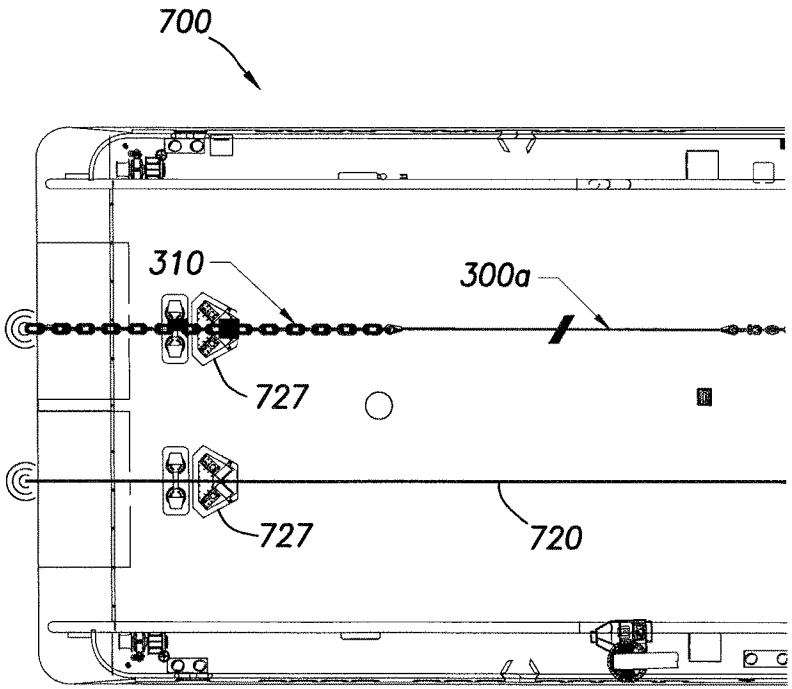
FIG. 1O is a top view of the AHV of FIG. 1N.
Figure 1M:
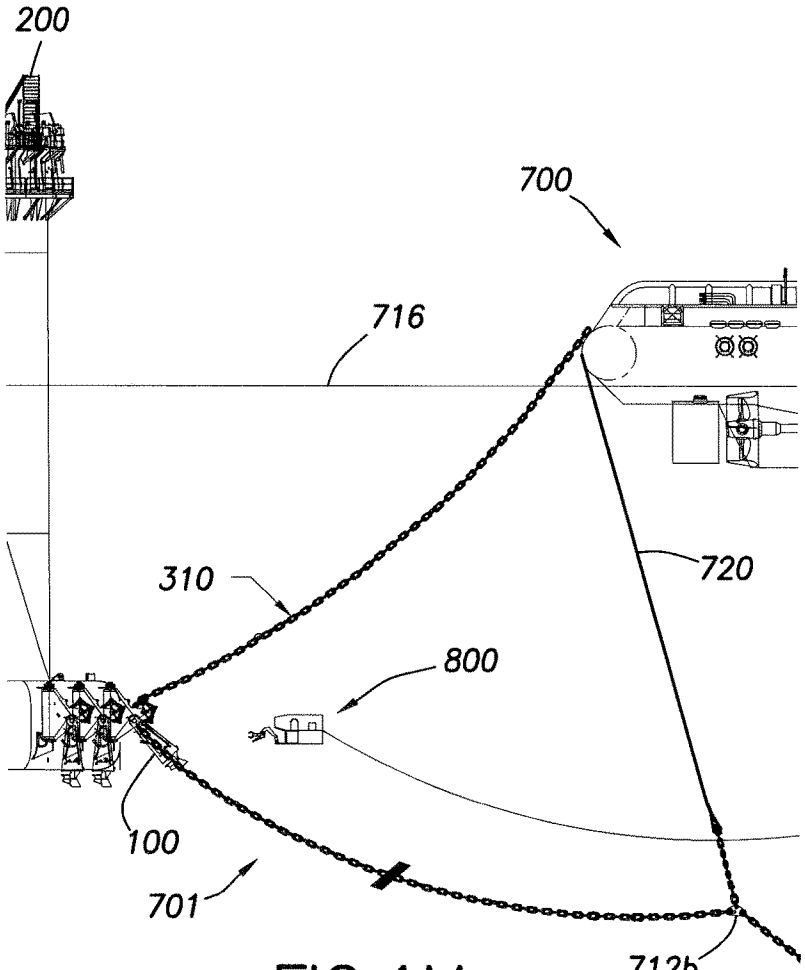
FIG. 1M is a side view of the vessel and AHV showing an ROV monitoring the provision of slack to the top chain of the mooring line.
Figure 2G:
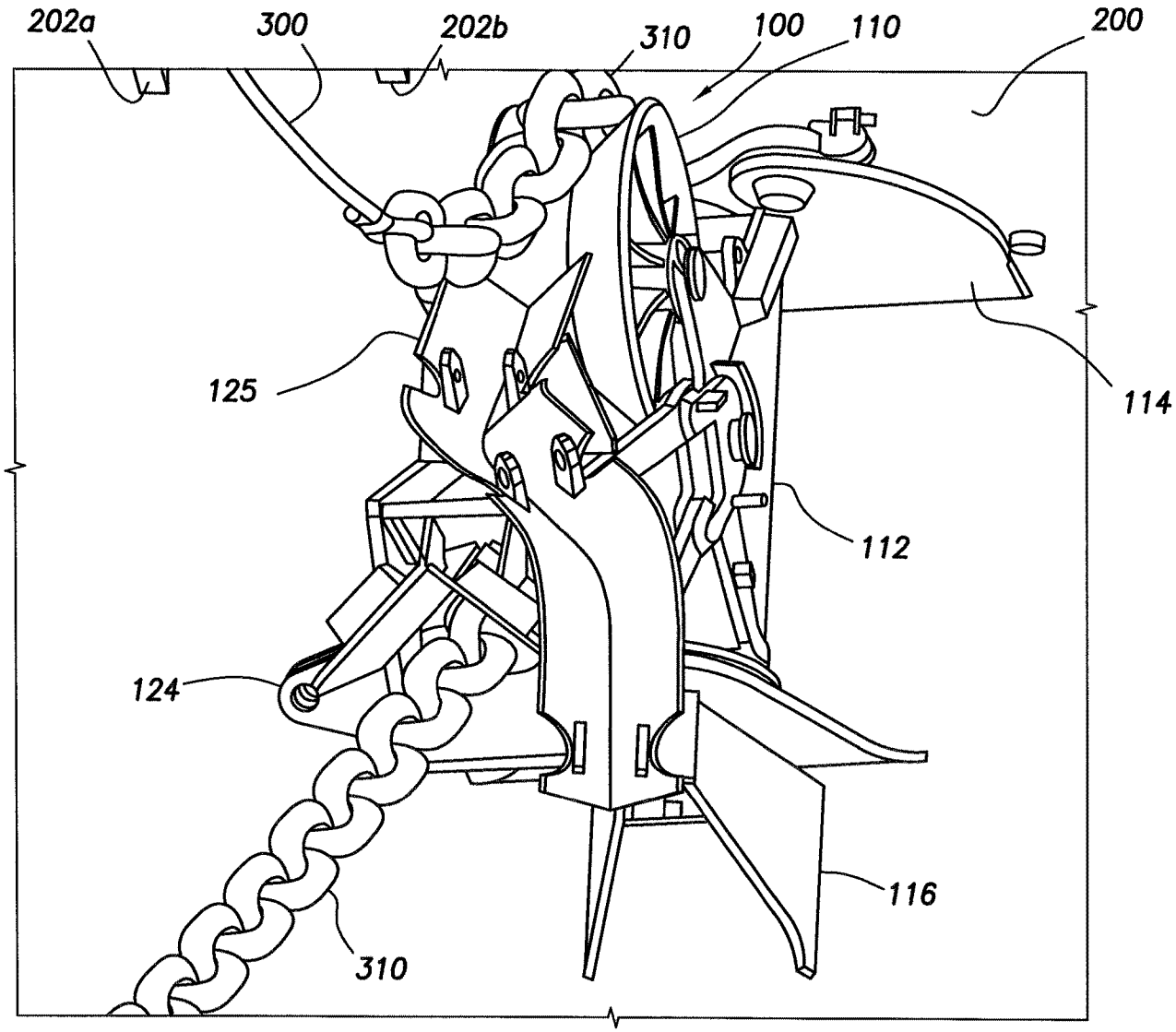
FIG. 2G depicts the fairlead stopper of FIG. 2F, after the mooring line is fully hauled-in, including a guide shoe and chain slack holder upon which a bitter end of the mooring line may be laid.
Figure 2H:
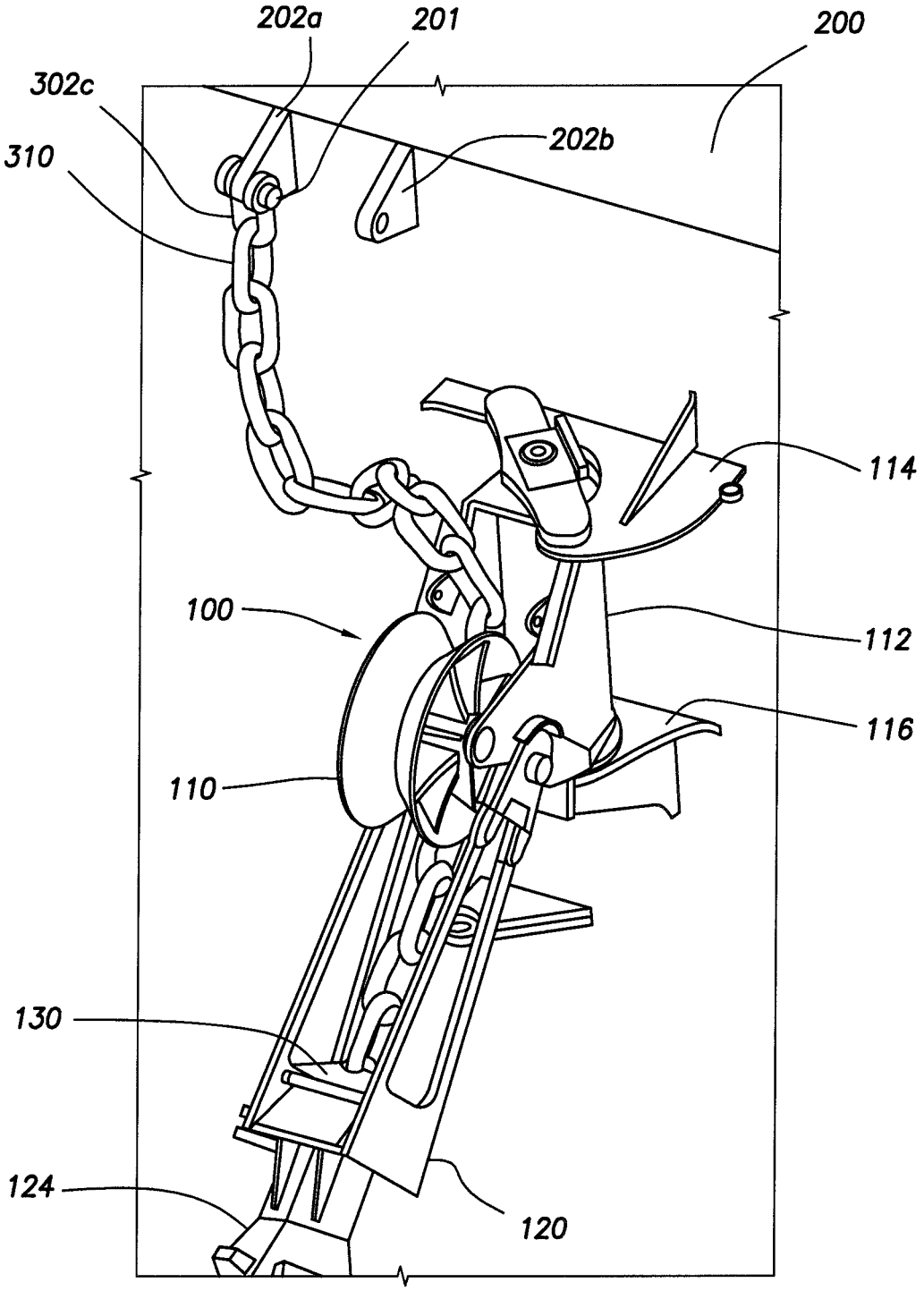
FIG. 2H depicts the fairlead stopper of FIG. 2F, after the mooring line is fully hauled-in, with the bitter end of the mooring line coupled with a pad eye on the floating structure.
Figure 21:
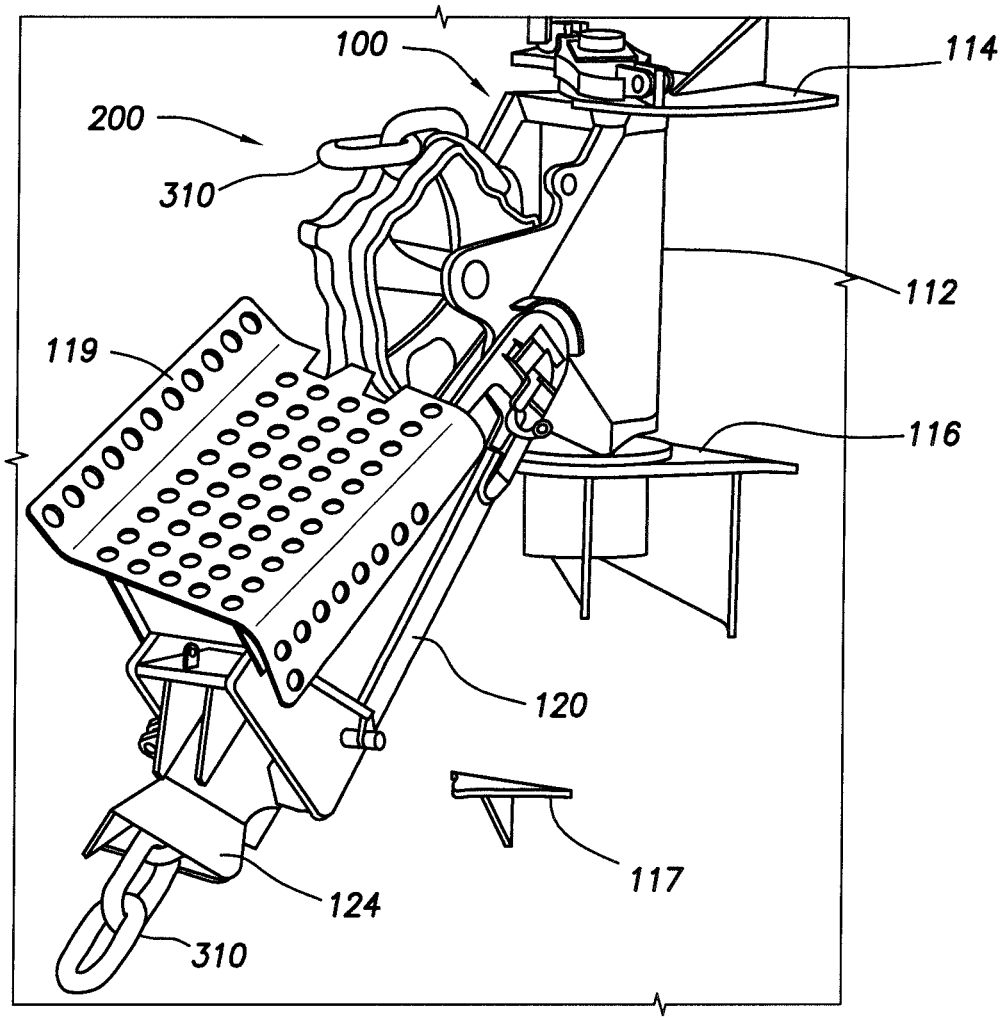

Turning now to FIGS. 1M-1O, the method includes providing slack to top chain 310 by releasing tension applied thereto from AHV 700, allowing fairlead stopper 100 to bear the load of mooring line 701, with the desired link of top chain 310 secured via latches of fairlead stopper 100. ROV 800 may be used to monitor the slacking of top chain 310. The method then includes moving first end 300*a* (platform hang-off rigging) to vessel 200 and securing it thereto, such as is shown in FIG. 2H.

Figures 1P, 1Q:
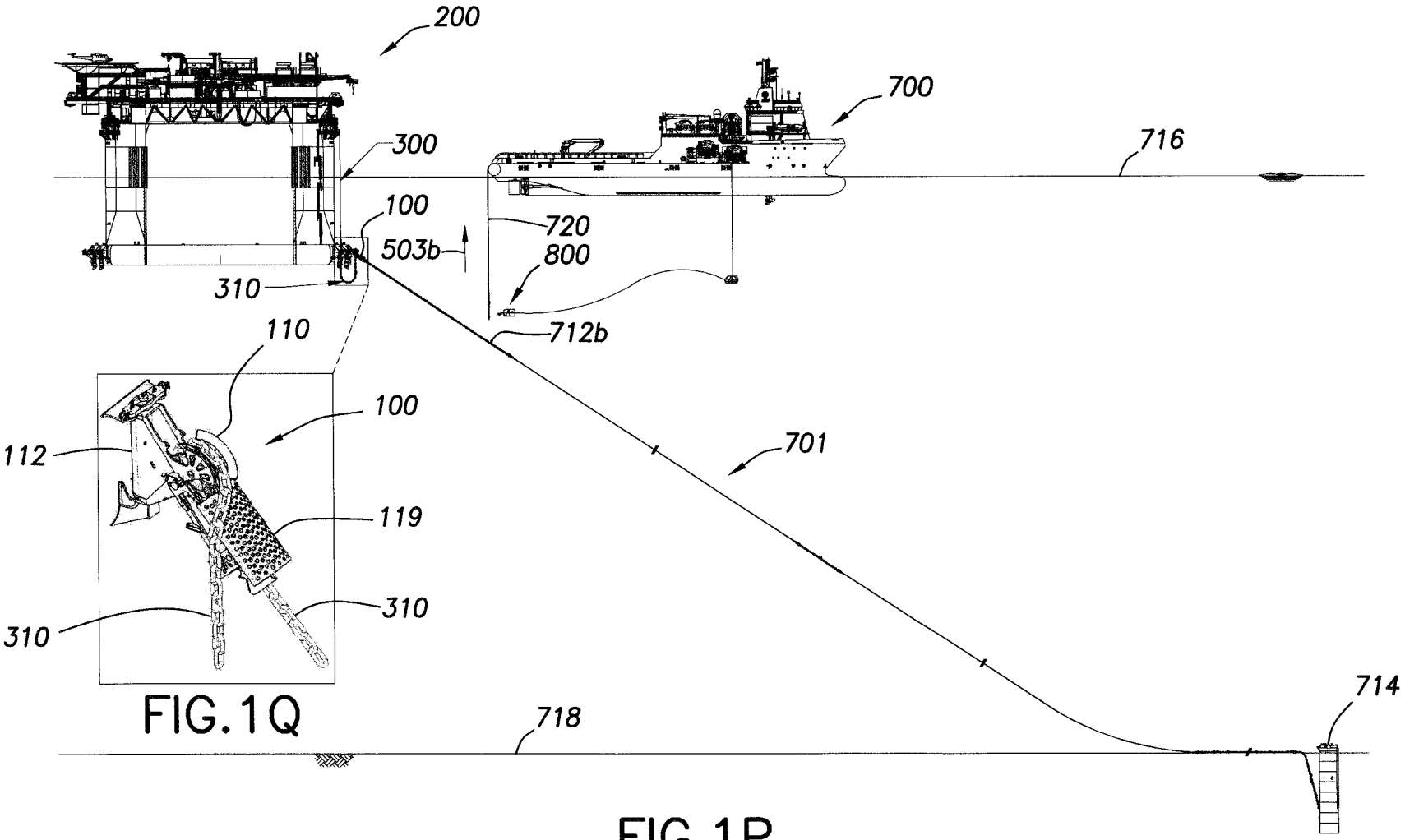
FIG. 1P is a side view showing the AHV releasing the mooring line after tensioning is completed.
FIG. 1Q is a detail view of the fairlead stopper of FIG. 1P.
Figure 1R:
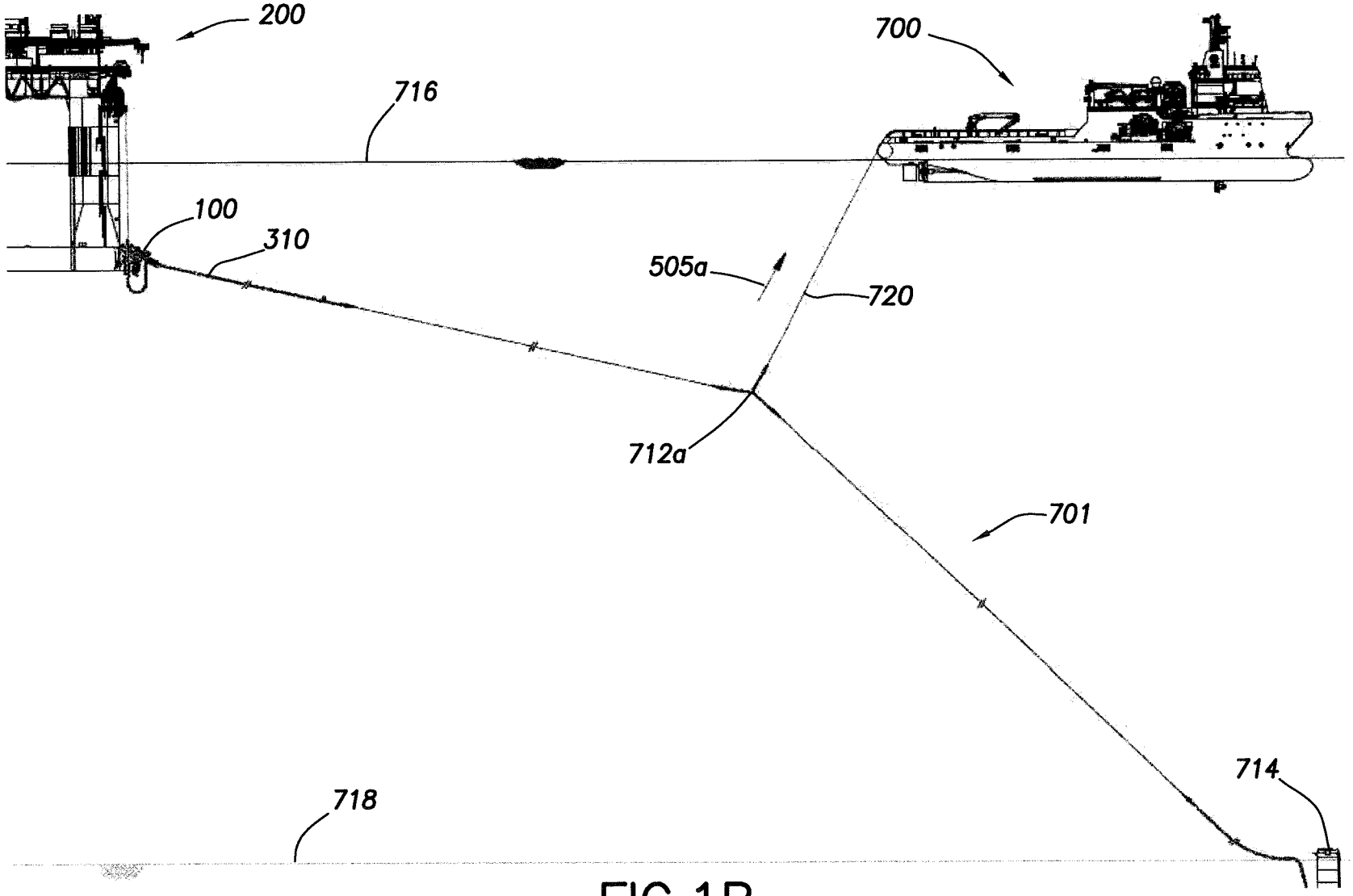
FIG. 1R is a side view showing the AHV performing stretching of a mooring line of a vessel.

Turning now to FIGS. 1P and 1Q, the method includes, after top chain 310 is disconnected from AHV 700, moving AHV 700 away from vessel 200 to a position above tension coupler 712*b*, and disconnecting tensioning line 720 therefrom, which may be facilitated via ROV 800. AHV 700 may then recover all lines and ROV 800 in preparation for the next mooring hook up and tensioning procedure. In some aspects, the end of top chain 310 is cut to remove excess chain. The length of the remaining excess, loose top chain 310 may be sufficient to allow for connection thereof to the hull of vessel 200, and/or connection of additional chain or wire for slackening operations for replacement or repair operations.

Stretching the Mooring Line

Once pretension is complete, AHV 700 may release load on top chain 310 bitter end and haul-in on the tensioning line 720 using a winch to pull on tension coupler 712*b*; thereby, stretching any stretchable portions of mooring line 701 (e.g., mooring line rope of midspans 724*a* and 724*b*), if needed or desired. For example, polyester ropes or the like undergo elongation and an increase in stiffness from the initial purchased length, and may require stretching, where 40-60% of minimum break load (MBL) may be achieved by stretching. AHV 700 may be moved to relocate more vertically above tension coupler 712*b* prior to pulling on tensioning line 720 to stretch mooring line 701. An exemplary polyester line having an initial MBL of 1,750 metric tons, has an MBL of 700 metric tons at the 40% MBL proof load. In some aspects, stretching of a polyester segment of the mooring line may increase the stiffness of that segment, such as from 11 times MBL to 15 times MBL. In some aspects, stretching is performed by pulling on the same tension coupler that tensioning line was coupled to during mooring line tensioning. In other aspects, stretching is performed by pulling on a different tension coupler than tensioning line was coupled to during mooring line tensioning.

Turning now to FIG. 1R, after tensioning and releasing mooring line 701, the method includes stretching at least portions of mooring line 701. The method may include positioning AHV 700 above tension coupler 712*a*, lowering line 720 to tension coupler 712*a*, and coupling line 720 to shackle 717 of tension coupler 712*a*. With line 720 and tension coupler 712*a* coupled, the method may include hauling in line 720 towards AHV 700 along direction 505*a* to impart a force on mooring line 701. This imparted force may result in a stretching of at least some portions of mooring line 701, such as polyester midspan lines 724*a* and 724*b*.

In some aspects each polyester segment (or other stretchable segment) of mooring line 701, such as midspan lines 724*a* and 724*b*, is stretched to at least 40% of that segments MBL. Such stretching may be performed to remove construction stretch from the line, and to minimize the need for further re-tensioning of the line.

As an example, Table 1 presents vessel and AHV loading data associated with proof tensioning a first mooring line (i.e., the first of all of the mooring lines of the vessel to be stretched) of a vessel to 40% MBL of the polyester, and Table 2 presents line loading data associated with proof tensioning the first mooring line to 40% MBL.

TABLE 1

| AHV Bollard Pull (mT) | Tensioning Line Tension @ stern (mT) | Mooring Line Tension @ Fairlead Stopper (mT) | Vessel Offset (m) |
|---|---|---|---|
| 259 | 483 | 735 | 46 |

TABLE 2

| Tensioning Line Tension @ Tension Coupler (mT) | Tension in Upper Polyester Segment (mT) | % MBL of Upper Polyester Segment | Tension in Lower Polyester Segment (mT) | % MBL of Lower Polyester Segment |
|---|---|---|---|---|
| 467 | 700 | 40 | 700 | 40 |

Table 3 presents vessel and AHV loading data associated with proof tensioning a last mooring line (i.e., the last of all of the mooring lines of the vessel to be stretched) of the vessel to 40% MBL of the polyester, and Table 4 presents line loading data associated with proof tensioning the last mooring line to 40% MBL.

TABLE 3

| AHV Bollard Pull (mT) | Tensioning Line Tension @ stern (mT) | Mooring Line Tension @ Fairlead Stopper (mT) | Vessel Offset (m) |
|---|---|---|---|
| 276 | 510 | 733 | 69 |

TABLE 4

| Tensioning Line Tension @ Tension Coupler (mT) | Tension in Upper Polyester Segment (mT) | % MBL of Upper Polyester Segment | Tension in Lower Polyester Segment (mT) | % MBL of Lower Polyester Segment |
|---|---|---|---|---|
| 494 | 700 | 40 | 700 | 40 |

In some aspects, the ratio of the lengths of the polyester segments 724*a* and 724*b* is optimized for proof loading to 40% while reducing tension and bollard pull. Table 5 presents some exemplary data of different length ratios between the polyester segments 724*a* and 724*b*. The bollard pull data in Table 5 does not account for vessel motion or offset.

TABLE 5

| Upper Polyester Segment Length (% of total length of both upper and lower polyester segments) | Lower Polyester Segment Length (% of total length of both upper and lower polyester segments) | AHV Bollard Pull Required (mT) | Tension @ Stern (mT) |
|---|---|---|---|
| 25 | 75 | 194 | 448 |
| 50 | 50 | 219 | 421 |
| 75 | 25 | 281 | 469 |

In view of the data in Table 5, in at least some embodiments the optimal polyester segment ratio is for the upper polyester segment (724*b*) to constitute 25% of a length of the total midspan (i.e., the combined length of 724*a* and 724*b*), and for the lower polyester segment (724*a*) to constitute 75% of a length of the total midspan. With such asymmetric polyester segments, the bollard pull required for stretching is reduced, while the utilization of line 720 increases.

In some aspects, after stretching is performed, the mooring line is again tensioned (e.g., in accordance with FIG. 1K). For example, top chain 310 may be reconnected with a shark jaw of AHV 700, line 720 may be reconnected with tension coupler 712*b*, and mooring line 701 may be pulled to a second tension. In certain aspects, each mooring line of a vessel is tensioned to a first tension, followed by stretching of each mooring line, followed by further tensioning of each mooring line to a second tension that is greater than the first tension.

Mooring Line Bitter End

The bitter end of top chain 310 may be secured, stored, and/or cut. With reference to FIG. 2G, in some aspects, after pretension is complete, the bitter end of top chain 310 is laid over the side of fairlead stopper 100 on a guide shoe 124, including chain slack holder 125. Chain slack holder 125 may be a structure on or of fairlead coupler 100 configured to retain top chain 310. In other aspects, the bitter end of top chain 310 is secured to the hull of vessel for permanent or long-term mooring. For example, with reference to FIG. 2H, the bitter end of top chain 310 may be coupled with pad eye 202*a* on vessel 200 via pin 201 and shackle 302*c*. In other aspects, the bitter end of top chain 310 is routed over a deflector plate 119 positioned over latch housing 120 and is thereon cut, as shown in FIG. 2I.

Figure 6B:
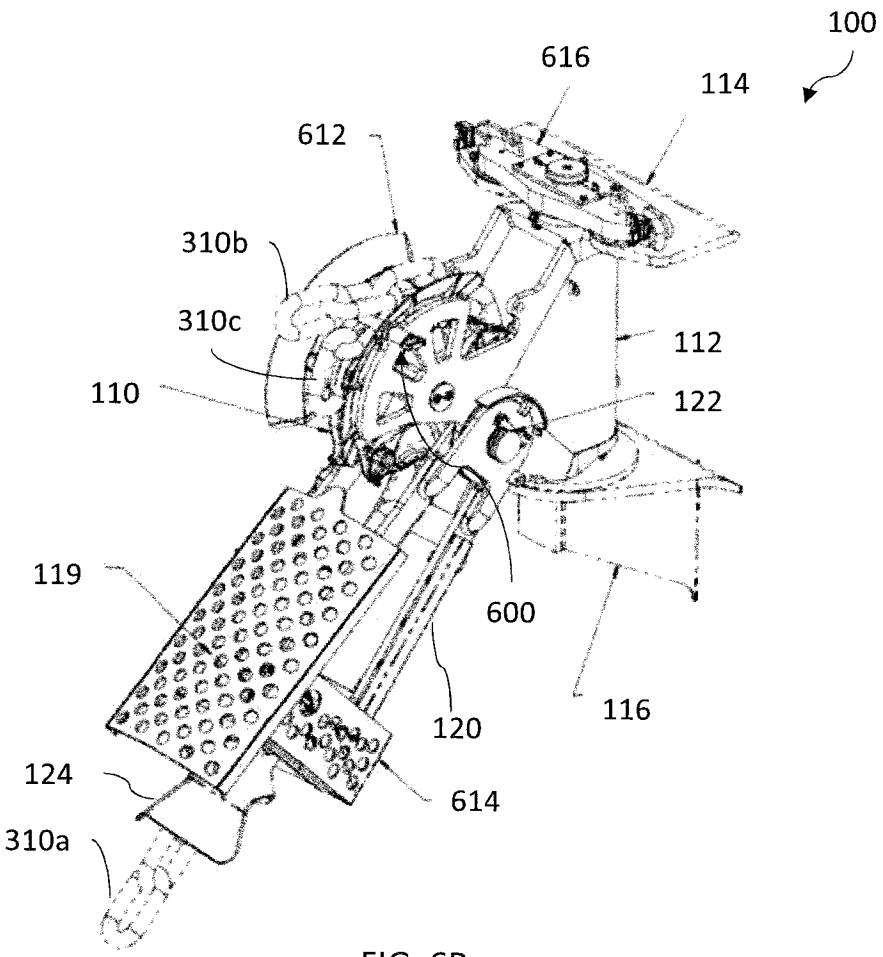
FIG. 6B is another perspective view of the fairlead stopper of FIG. 6A.
Figure 6A:
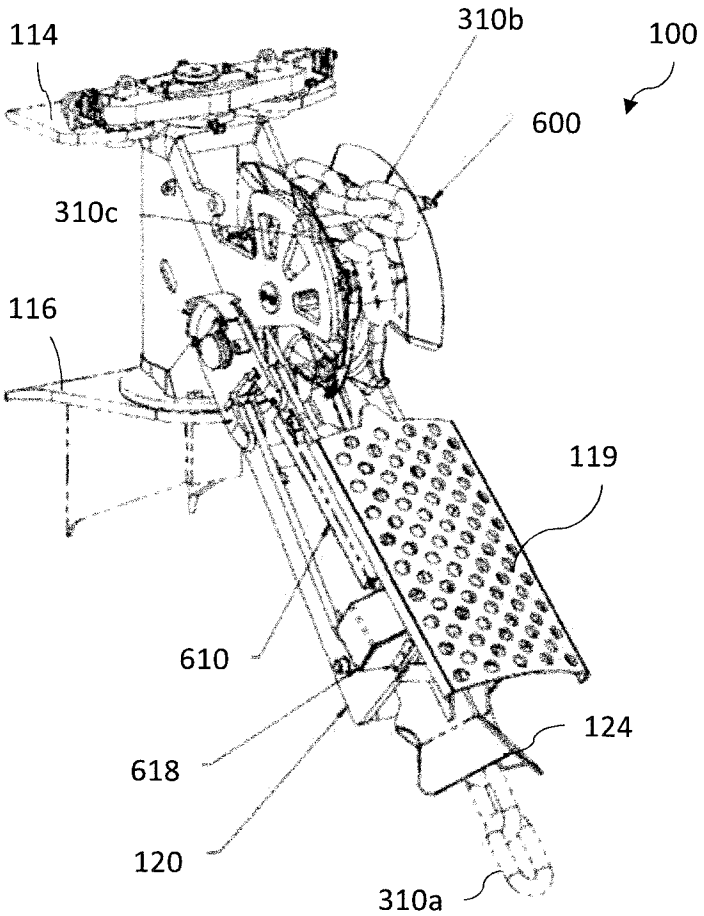
FIG. 6A is a perspective view of a fairlead stopper, including a chain and wheel locking pin.
Figure 6D:
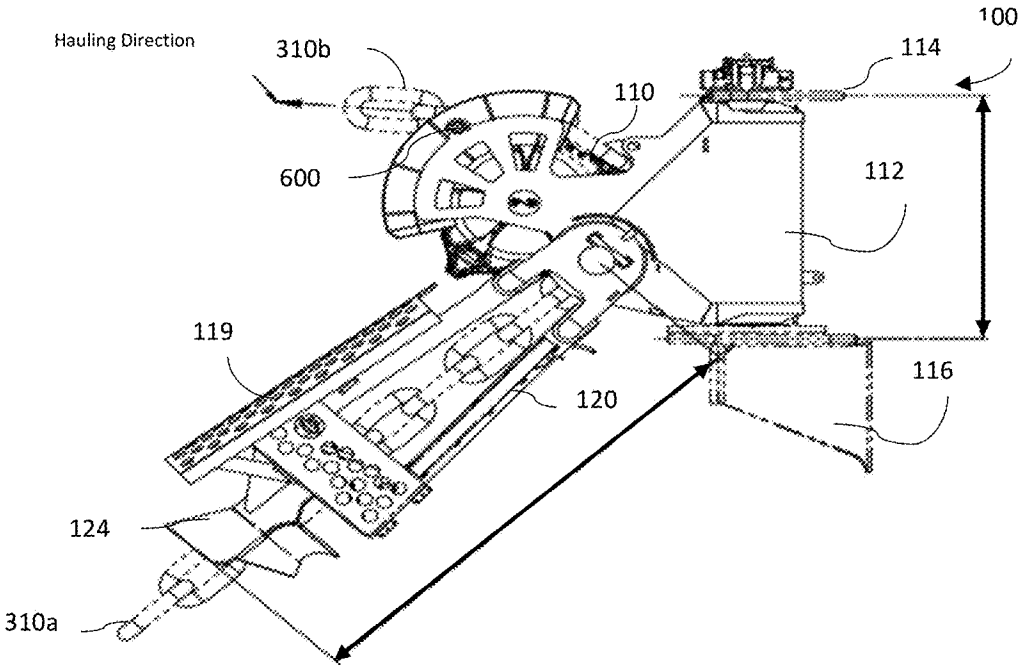
FIG. 6D is a side view of the fairlead stopper of FIG. 6A.
Figure 6C:
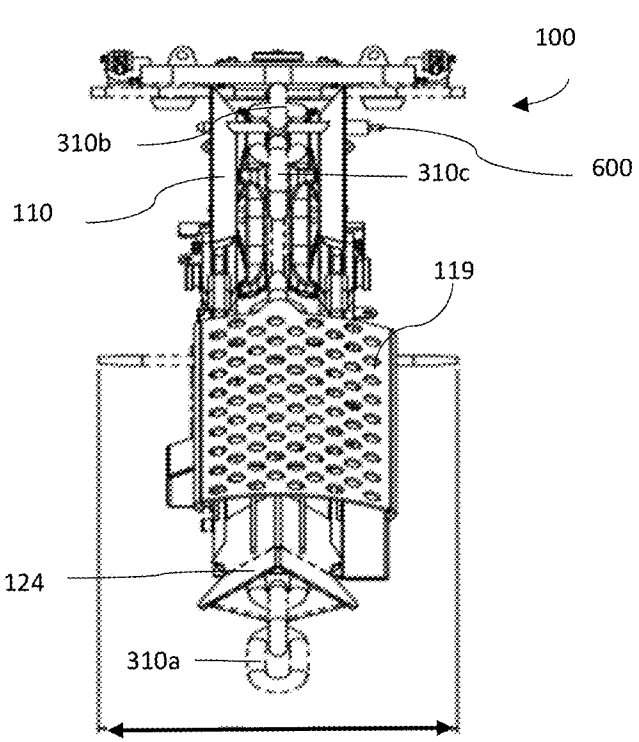
FIG. 6C is a front view of the fairlead stopper of FIG. 6A.
Figure 6E:
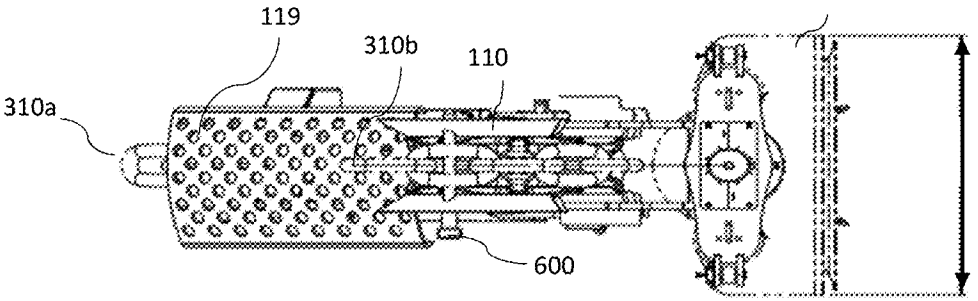
FIG. 6E is a top view of the fairlead stopper of FIG. 6A.

FIGS. 6A-6E depict another embodiment of fairlead stopper 100, illustrating one method of handling the bitter end of mooring lines in accordance with the present disclosure. Fairlead stopper 100 includes chain and wheel locking pin 600. In operation, when hauling in or paying out the mooring line along hauling direction (as indicated in FIG. 6D), pin 600 may be removed from chain wheel 110, such that the mooring chain enters fairlead stopper 100, as indicated via chain 310*a*, and travels on chain wheel 110 as indicated via 310*b*. After tensioning is complete, the mooring chain may be pinned to fairlead stopper 100, with excess mooring chain cut off or disconnected. While 310*a* indicates the position of the mooring chain during tensioning, 310*c* indicates the position of mooring chain after tensioning, with the mooring chain pinned off. Mooring chain 310*c* is engaged about chain wheel 110, and pin 600 is engaged with fairlead stopper 100 to maintain chain 310*c* held on chain wheel 110. As shown in FIGS. 6A-6E, pin 600 is engaged through chain guide 612, such that pin 600 holds chain 310*c* in engagement with chain wheel 110, preventing chain 310*c* from disengaging from chain wheel 110. Fairlead stopper 100 may engage with upper bracket 114 via upper retainer 616. Fairlead stopper 100 also includes linear transducer 610 for actuating latches, latch locker and cover 618, and linkage cover 614. While not shown, fairlead stopper 100 also includes, within latch housing 120, latches, synchronizing linkage between latches, and latch tension springs for operation of at least one embodiment of the fairlead stopper.

In some aspects, a connecting link is included in the mooring line. The connecting link may be disconnected from the mooring line after tensioning is completed to remove excess tail chain.

After tensioning, and optionally stretching, is completed, AHV 700 may then move onto the next mooring line of vessel 200 or another vessel for tensioning and/or stretching operations.

Tri Plate Connector

Figure 3:
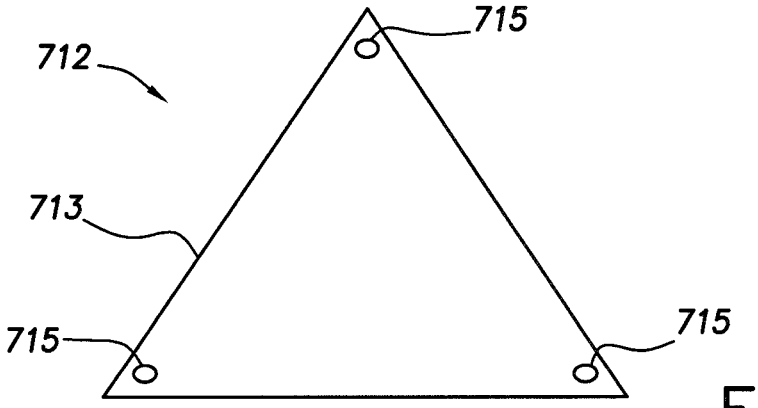
FIG. 3 depicts a tension coupler for coupling lengths of mooring line together and providing a load point for application of tension to the mooring line for stretching.

One exemplary tension coupler 712 is depicted in FIG. 3. Tension coupler 712 shown in FIG. 3, also referred to as a tri-plate connector, includes body 713 with through-holes 715 positioned therethrough. Body 713 may be or include steel. Each through-hole 715 may be positioned and configured to connect with a rope, chain, wire, or other tensioning or mooring line, such as via shackles. In some aspects, tension coupler 712 is configured to couple with segments of mooring line 701 such that the segments of mooring line 701 may be tensioned and may extend in substantial linear alignment with one another. For example, midspans 724*a* and 724*b* and top chain 310 may be coupled with through-holes 715 such that top chain 310 and midspans 724*a* and 724*b* extend in linear alignment along a direction (or at least parallel) when mooring line 701 is tensioned. Also, through-holes 715 may be arranged such that tensioning line 720 may be coupled therewith to apply a tensioning or pulling force along another direction that is perpendicular to, or at least not parallel to, the direction of extension of mooring line 701.

Moored Vessel

Figure 4:
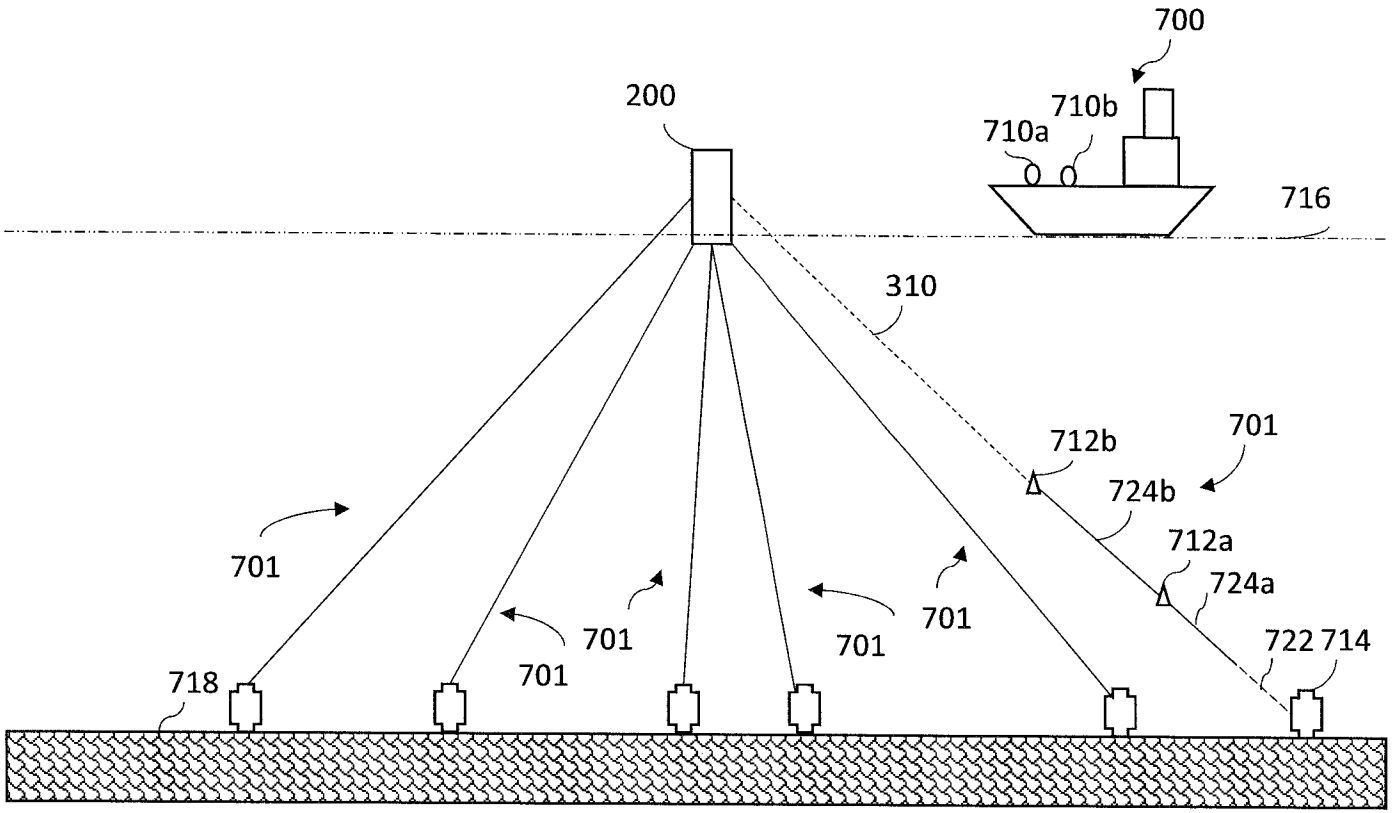
FIG. 4 is an at least partially moored floating structure.
Figure 5:
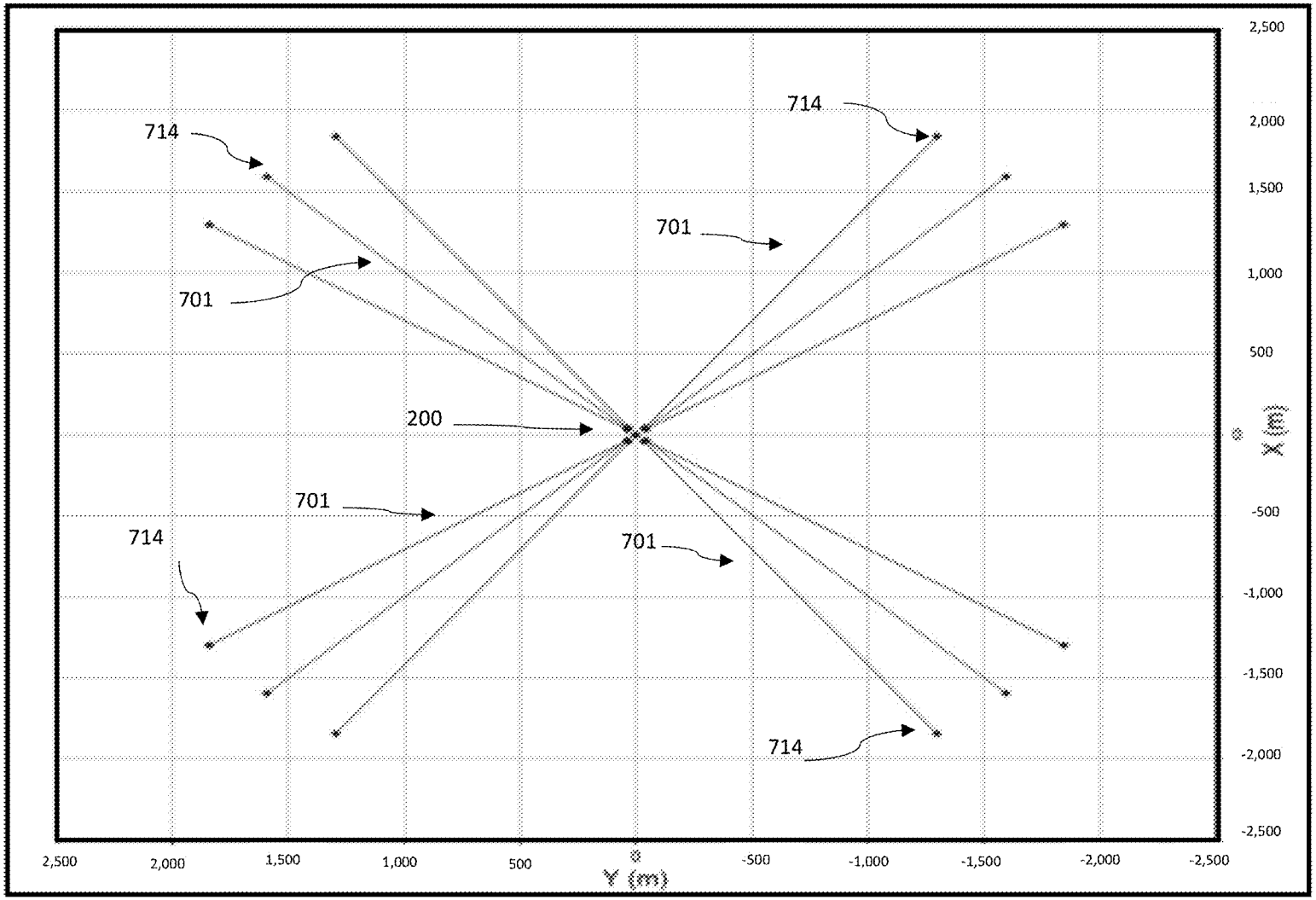
FIG. 5 is a graph of one exemplary mooring system pattern.

FIG. 4 depicts vessel 200, which is moored via plurality of mooring lines 701, each including an anchor 714, bottom chain 722, midspans 724*a* and 724*b*, top chain 310, and tension couplers 712*a* and 712*b*. For simplicity, the details of only one of mooring lines 701 are shown. Also shown is AHV 700 with two winches 710*a* and 710*b*. FIG. 5 is a graph of one exemplary mooring system pattern with vessel 200, a plurality of mooring lines 701, and a plurality of anchors 714.

Table 6, below, shows component lengths of one exemplary mooring line during different stages of the presently disclosed mooring and tensioning procedure. The polyester segment lengths account for the estimated elongation from being loaded.

TABLE 6

| Mooring Line Segment | Initial Connection | Pre-Tension to 250 mT | Proof Loading to 40% Polyester MBL | Pre-Tension to 300 mT |
|---|---|---|---|---|
| Top Chain | 350 m | 276 m | 276 m | 229 m |
| Upper Polyester Segment | 1,045 m | 1,059 m | 1,075 m | 1,075 m |
| Lower Polyester Segment | 1,045 m | 1,059 m | 1,075 m | 1,075 m |
| Bottom Chain | 250 m | 250 m | 250 m | 250 m |

Additional Aspects and Variations

The following highlights aspects and variations of some embodiments of the present method. However, the present method is not limited to these aspects and variations.

Installation and Maintenance

As disclosed herein, the fairlead stoppers used in the mooring method may be mounted on the hull, either below or above the waterline. If the fairlead stopper is located below the water line, then the fairlead stopper may be positioned outside of the splash zone. The fairlead stopper, which may be installed at port, may be mounted relatively high-up on the hull, above the waterline, such as to provide for access for inspection or installation quayside at the shipyard instead of in the dry dock. As such, the fairlead stoppers may be available for power washing and inspection prior to leaving for the installation site, making it easier for ROV operations offshore and reeving chain, and also mitigating risk prior to arriving on site for mooring hook up.

Instrumentation on the fairlead stopper may be designed and configured for a relative long-duty life and, in some applicants, may not require replacement for substantial periods of time. In some aspects of the mooring method, the fairlead stoppers require no long-term maintenance other than visual inspections. For example, cleaning and visual inspection once every 5 years may be sufficient for maintenance of the fairlead stoppers. Bearing wear inspection and measurement may also be performed on the fairlead stoppers. If replacement or maintenance of the fairlead stoppers is required, load instrumentation on the fairlead stoppers may be removed and replaced by diver or ROV without disturbing the mooring load thereon. That is, in some aspects, such instrumentation on the fairlead stopper does not include a load cell located in the load path. Strain in the housing of the fairlead stopper may be measured to determine load, such that removal and replacement may occur without requiring removal of the mooring load. In some such aspects, the method includes avoiding the use of acoustic systems for monitoring load on the fairlead stoppers. As such, maintenance of the equipment may be reduced or eliminated, as the present fairlead stoppers are, in at least some aspects, maintenance free or substantially maintenance free. The methods may also be used to reduce mooring line installation time and costs.

Reduction in Weight

In certain aspects, the present method reduces the weight on the moored vessel and/or the mooring line in comparison to methods using an inline tensioner (ILT). For example, in methods that use an ILT, the ILT and tail chain (adjustment chain of the mooring line) are left hanging, midspan, from the top chain. The weight of the ILT on the top chain has long-term effects on fatigue and life of the chain. Furthermore, the weight of the ILT on the top chain affects the shape of the catenary of the top chain, which causes other risks and effects on mooring performance. Also, the weight of the ILT on the top chain increases the buoyancy requirements, or reduces topsides weight capacity of the vessel.

In some aspects, the mooring methods disclosed herein provide for reduced weight of deck equipment on the moored vessels by eliminating some or all tensioning devices thereon. Thus, the methods disclosed herein provide for freeing of space on deck of the moored vessel for other uses by eliminating some or all tensioning devices and associated hydraulic power units, controls and piping. The methods disclosed herein may also eliminate the need to store tail chain on board in chain lockers, further reducing weight on board the vessel. In some aspects, the cost of mooring equipment is reduced when the present method is utilized in comparison to methods that use ILTs.

Motion Control

In certain aspects, the present method eliminates problems associated with controlling the motion of the ILT during tensioning operations. As an ILT does not run freely on the mooring line when lifting, the AHV lifts the entire mooring line catenary upwards until enough load is achieved to overcome friction, at which point the ILT runs down the chain, falling until the friction takes over again and stops the ILSs motion. Thus, when using an ILT, it is difficult to control how much chain is pulled in as the ILT typically moves past the "golden" link, such that chain must be paid out to get back to the "golden" link. Paying out chain can be difficult, sometimes requiring the use of stopping devices attached to a chain link so that the "golden" link is forced to stop when it reaches the latching device. The use of such stopping devices causes an impact load on the chain and ILT when the ILT is moving down the chain and suddenly clashes with the stopping device.

In some aspects of the present method, when the AHV pulls the top chain, the top chain passes relatively smoothly through the fairlead stopper, as the method does not depend on weight of a chain tensioner device to overcome resistance to movement in the fairlead stopper. Thus, in some such aspects, the method disclosed herein avoids sudden, uncontrolled movements of the mooring line; reduces the possibility of damage to the mooring line or the tensioner assembly relative to in-line tensioners; increases safety relative to in-line tensioners; and reduces the occurrence of stretch in the mooring line and stalling of the winches relative to in-line tensioners.

Paying Out Mooring Line

In certain aspects, the present method does not exhibit at least some of the problems exhibited by methods that use ILTs during pay out of mooring line. ILTs require an ROV to control the latch actuation to allow chain to be paid out. Locking the latches open is a risky operation, as the locking mechanism may fail. Also, the ILT may be positioned too deep for divers to repair. Furthermore, ILTs are suspended in the catenary of the mooring line, and not attached to a rigid structure, such as the vessel hull. If the latch mechanism of an ILT cannot be held open, extraction of the chain from the ILT for retrieval and/or repair is prevented.

In some aspects of the present method, the method includes paying out additional mooring line. The bitter end of the top chain may be retrieved (e.g., by unpinning the bitter end from the hull of the vessel). The bitter end of the top chain may then be coupled with one of the winches of the AHV, which may then pull the mooring line taut, such that the latches of the fairlead coupler are free to open. An ROV or diver may open the stopper latches, which may also be operable by wire rope from the hull above, and lock the latches in the open position. The AHV may then pay out mooring line until the desired tension is achieved, or may pay out all the mooring line if disconnection from the mooring line is required.

Simplification of Tail Chain Handling

In certain aspects, the present method simplifies tail chain handling, relative to methods that use ILTs. Handling of the tail chain after tensioning using an ILT can be difficult, and requires cutting of the tail chain by an ROV. When cut, the tail chain includes two loose half-links, and the remainder of the tail chain must be retained and handled. Also, special handling tools are required to ensure that no parts fall, uncontrolled, after cutting of the tail chain. The tail chain is laid over one side of the ILT and, depending on the tail chain weight, a twist in the mooring line could be induced by the tail chain hanging over the one side. Twisting load on the links in the ILT that may have long term effects on chain wear.

In some aspects of the present method, after the mooring line is hauled through the fairlead stopper and pretensioned, the bitter end of the mooring line may be positioned over to the hull of the vessel and pinned off to an eye using a standard shackle. In some such aspects, this allows the mooring line to be easily accessed at a later time for re-tensioning, if required. In some aspects, the mooring line is not subjected to twisting (e.g., 180-degree twists) during mooring operations, thus, reducing the occurrence of inter-link wear and increasing the life of the chain relative to in-line tensioners. In certain aspects of the present method, after tensioning the mooring line, the tail chain (bitter end) does not require cutting, which can save time, money, increase safety, and increase available deck space on the vessel in comparison to methods that use in-line tensioners.

In some aspects, operations of the hook up and tensioning procedures disclosed herein may be facilitated via use of simulation and analysis software, such as OrcaFlex 10.0d.

While specific embodiments and equipment are shown and described herein, one skilled in the art would understand that the methods, systems, and apparatus disclosed herein are not limited to these particular embodiments described.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A method of mooring a floating vessel having a fairlead stopper coupled thereto, the method comprising:

hauling in a mooring line that is anchored to a seafloor into and at least partially through the fairlead stopper by pulling a messenger line coupled with the mooring line toward an anchor handling vessel, wherein the mooring line is hauled in until a first tension on the mooring line is attained, and wherein the fairlead stopper secures a position of the mooring line to at least partially maintain the first tension on the mooring line; and while hauling in the mooring line, pulling a tensioning line toward the anchor handling vessel to apply tension thereto, wherein the tensioning line is coupled between the anchor handling vessel and a tension coupler that is positioned along the mooring line.

2. The method of claim 1, further comprising, prior to hauling in the mooring line:

coupling a first end of the messenger line to a first end of the mooring line, wherein the messenger line is reeved through the fairlead stopper, and wherein a second end of the mooring line is anchored to a seafloor;

coupling a second end of the messenger line on the anchor handling vessel;

coupling a first end of the tensioning line, extending from the anchor handling vessel, with the tension coupler.

3. The method of claim 2, further comprising, prior to coupling the first end of the messenger line to the first end of the mooring line, retrieving the mooring line from the seafloor onto the anchor handling vessel, and retrieving the first end messenger line from the floating vessel onto the anchor handling vessel; and after the messenger line and the mooring line are coupled, releasing the mooring line and the first end of the messenger line from the anchor handling vessel.

4. The method of claim 2, wherein the second end of the messenger line is pulled by a first winch on the anchor handling vessel, and wherein a second end of the tensioning line is pulled by a second winch on the anchor handling vessel.

5. The method of claim 1, wherein applying tension to the tensioning line exerts a horizontal load on the anchor handling vessel that is directed away from the floating vessel.

6. The method of claim 1, further comprising, prior to pulling the tensioning line, positioning the anchor handling vessel above the tension coupler.

7. The method of claim 1, further comprising, after the first tension on the mooring line is secured, applying a stretching force to at least a portion of the mooring line by:

pulling the tensioning line coupled with the tension coupler, thereby stretching at least a portion of the mooring line; or coupling the tensioning line or another line with a second tension coupler, the second tension coupler positioned along a length of the mooring line, and pulling the tensioning line or other line, thereby stretching at least a portion of the mooring line.

8. The method of claim 7, wherein at least one segment of the mooring line is stretched to at least 40% of that segments MBL.

9. The method of claim 7, further comprising, after applying the stretching force, re-tensioning the mooring line to a second tension, wherein the second tension is greater than the first tension.

10. The method of claim 2, wherein, prior to coupling the messenger line with the mooring line and the anchor handling vessel, the first and second ends of the messenger line are coupled with a hull of the floating vessel, with the messenger line reeved through the fairlead stopper.

11. The method of claim 10, wherein the first and second ends of the messenger line are coupled with pad eyes on the hull of the floating vessel.

12. The method of claim 1, wherein the fairlead stopper includes latches positioned to engage with links of the mooring line as the mooring line is pulled through the fairlead stopper, wherein the latches ratchet with the links of the mooring line such that the latches successively secure the mooring line as the mooring line is tensioned.

13. The method of claim 1, further comprising, after the first tension on the mooring line is attained:

securing a bitter end of the mooring line to a hull of the floating vessel;

positioning the bitter end of the mooring line on a chain slack holder of the fairlead stopper;

routing the bitter end of the mooring line over a deflector plate of the fairlead stopper and cutting the bitter end;

disconnecting a link from the mooring line to remove excess tail chain; or pinning the bitter end onto the fairlead stopper.

14. The method of claim 1, wherein the mooring line includes:

a bottom chain coupled with an anchor at the seafloor;

a first midspan line coupled with the bottom chain opposite the anchor;

a second midspan line coupled with the first midspan line opposite the bottom chain, wherein the second midspan line is coupled with the first midspan line via a second tension coupler; and a top chain coupled with the second midspan line opposite the first midspan line, wherein the top chain is coupled with the second midspan line via the tension coupler.

15. The method of claim 14, wherein the midspan lines include a polymer or steel wire.

16. The method of claim 14, wherein the first midspan line has a length that is greater than a length of the second midspan line.

17. The method of claim 1, wherein the tension coupler includes is a plate having through-holes disposed therethrough, the through-holes positioned and arranged on the plate for attachment with segments of the mooring line and with the tensioning line.

18. The method of claim 17, wherein the tension coupler includes chains for attachment with segments of the mooring line and a shackle for attachment with the tensioning line.

19. The method of claim 2, wherein coupling the first end of the messenger line to the first end of the mooring line includes securing the first end of the messenger line in a shark jaw on the anchor handling vessel, securing the first end of the mooring line a second shark jaw on the anchor handling vessel, and connecting the messenger line with the mooring line.

20. The method of claim 2, wherein, after the messenger line and the mooring line are coupled, releasing the messenger line and the mooring line overboard of the anchor handling vessel such that the fairlead stopper bears the load of mooring line.

21. The method of claim 1, wherein the mooring line is hauled in until a predetermined link of the mooring line is secured by latches of the fairlead stopper.

22. The method of claim 21, further comprising monitoring the engagement between the mooring line and the latches of the fairlead stopper with an ROV.

23. The method of claim 1, wherein load imparted to the anchor handling vessel from hauling in the mooring line are at least partially counteracted by loads imparted to the anchor handling vessel from the tensioning line.

24. The method of claim 1, wherein pulling the tensioning line lifts the mooring line and reduces load imparted from the mooring line onto the messenger line.

25. The method of claim 1, further comprising, after the first tension is attained, providing slack to a portion of the mooring line extending between the fairlead stopper and the anchor handling vessel such that the fairlead stopper bears the load of the mooring line, and disconnecting the tensioning line from the tension coupler.

26. The method of claim 1, wherein each mooring line of the floating vessel is tensioned to the first tension, followed by stretching of each mooring line of the floating vessel, followed by further tensioning of each mooring line of the floating vessel to a second tension, wherein the second tension is greater than the first tension.

27. The method of claim 1; further comprising paying out additional mooring line, including:

retrieving a bitter end of the mooring line, and coupling the bitter end with a winch on the anchor handling vessel;

pulling the mooring line taut to open latches of the fairlead stopper; and paying out the mooring line.

28. The method of claim 1, further comprising stretching at least one segment of the mooring line by simultaneously pulling on the mooring line and pulling on the tensioning line or another line, wherein the simultaneous pulling is performed while the tensioning line or other line is coupled with the tension coupler or with a second tension coupler that is positioned along a length of the mooring line.

* * * * *